US012660912B2

(12) United States Patent
Choi

(10) Patent No.: US 12,660,912 B2
(45) Date of Patent: Jun. 23, 2026

(54) SUPPORTING ASSEMBLY WITH LOCKING MECHANISM AND FOLDABLE STRUCTURE HAVING SAME

(71) Applicant: Inno-Sports Co., Ltd., Xiamen (CN)

(72) Inventor: Kwan Jun Choi, Xiamen (CN)

(73) Assignee: Inno-Sports Co., Ltd., Xiamen (CN)

( * ) Notice: Subject to any disclaimer, the term of this patent is extended or adjusted under 35 U.S.C. 154(b) by 93 days.

(21) Appl. No.: 18/659,765

(22) Filed: May 9, 2024

(65) Prior Publication Data

US 2025/0098848 A1 Mar. 27, 2025

(30) Foreign Application Priority Data

Sep. 27, 2023 (CN) ..... 202322627439.4
Sep. 27, 2023 (CN) ..... 202322632917.0
Sep. 27, 2023 (CN) ..... 202322632928.9

(51) Int. Cl.
*A47B 3/08* (2006.01)

(52) U.S. Cl.
CPC .... *A47B 3/0818* (2013.01); *A47B 2003/0821* (2013.01); *A47B 2200/0037* (2013.01)

(58) Field of Classification Search
CPC ..... A47B 3/08; A47B 3/0809; A47B 3/0818; A47B 3/0911; A47B 2003/0821; A47B 2200/0037
See application file for complete search history.

(56) References Cited

U.S. PATENT DOCUMENTS 6,047,442 A * 4/2000 Workman ..... A45C 13/262 16/113.1
10,470,561 B2 * 11/2019 Clegg ..... A47B 3/083
11,241,087 B2 * 2/2022 Choi ..... A47B 83/024
11,612,239 B2 * 3/2023 Liu ..... A47B 9/20 108/147.19
11,882,930 B2 * 1/2024 Choi ..... A47B 3/0913
11,896,119 B2 * 2/2024 Nye ..... A47B 3/0812
12,458,138 B2 * 11/2025 Nye ..... A47B 3/0812
2021/0007474 A1 * 1/2021 Nye ..... A47B 3/0812
2021/0169215 A1 * 6/2021 Chen ..... A47B 3/0809

* cited by examiner

*Primary Examiner* — Eret C McNichols

(74) *Attorney, Agent, or Firm* — MORGAN, LEWIS & BOCKIUS LLP

(57) ABSTRACT

Disclosed are supporting assemblies and foldable structures having supporting assemblies. A supporting assembly includes a locking mechanism that is easy to operate. The locking mechanism is configured to lock the supporting assembly in an unfold state to prevent inadvertent folding of the supporting assembly. It can be unlocked easily when folding the supporting assembly is desired. Additionally or optionally, the supporting assembly includes a protecting component configured to enhance safety during the operation of the locking mechanism.

20 Claims, 27 Drawing Sheets

200

SUPPORTING ASSEMBLY WITH LOCKING MECHANISM AND FOLDABLE STRUCTURE HAVING SAME

CROSS-REFERENCE TO RELATED APPLICATIONS

The present application claims priority to Chinese Utility Model applications Ser. No. 202322627439.4 filed Sep. 27, 2023, No. 202322632917.0 filed Sep. 27, 2023, and No. 202322632928.9 filed Sep. 27, 2023. The disclosure of each application is incorporated herein for all purposes by reference in its entirety.

FIELD OF THE INVENTION

The present invention generally relates to supporting assemblies with locking mechanisms and foldable structures having such supporting assemblies.

BACKGROUND

Foldable tables are popular because they require less storage space and are easy to carry around. An existing foldable table generally includes one or more panels coupled to a supporting frame having two or more foldable legs. However, many exiting foldable tables lack a mechanism to control the folding and unfolding of the tables, in particular, a mechanism to lock the legs when the tables are in use. As a result, these existing foldable tables may wobble, and in some cases, may fold accidentally. Some existing foldable tables employ locking means to lock the legs, but the locking means of these existing foldable table may pinch user's hands inadvertently and thus may not be safe to use.

Given the current state of the art, there remains a need for locking mechanisms, supporting assemblies and tables that address the abovementioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present disclosure provides supporting assemblies and foldable structures that can be safely and conveniently folded and unfolded.

In various exemplary embodiments, the present disclosure provides a supporting assembly including a first bar, a second bar, a first leg, a second leg, and a locking mechanism. Each of the first and second legs includes an inner bar and an outer bar, with a distal end of the inner bar connected to the first bar and a distal end of the outer bar configured to abut a surface. The inner and outer bars of each of the first and second legs are coupled with each other and movable relative to each other in a first direction. The second bar is connected to the outer bar of the first leg and the outer bar of the second leg. The locking mechanism includes a first component disposed at the first bar and a second component disposed at the second bar. The first and second components are operable to selectively engage with each other to prevent relative movement of the inner and outer bars of each of the first and second legs or disengage from each other to allow relative movement of the inner and outer bars of each of the first and second legs.

In some exemplary embodiments, the second bar is substantially parallel to the first bar.

In some exemplary embodiments, when the first and second components of the locking mechanism are engaged with each other, a proximal end of the outer bar of the first or second leg abuts the first bar.

In an exemplary embodiment, the proximal end of the outer bar includes a supporting piece having a recess to fit on the first bar when the first and second components of the locking mechanism are engaged with each other.

In some exemplary embodiments, the first component of the locking mechanism includes a tongue and the second component of the locking mechanism includes a buckle.

In some exemplary embodiments, the second bar includes one or more openings on a first side and one or more first slots on a second side of the second bar. The first side of the second bar faces the first bar, and each of the one or more first slots is elongated in a second direction substantially perpendicular to the first direction. The first component of the locking mechanism includes one or more coupling members insertable into the one or more openings of the second bar. The second component of the locking mechanism includes a button and one or more first pins. The button includes one or more second slots each elongated in a direction oblique to both of the first and second directions and corresponding to a first slot in the one or more first slots of the second bar. In some such embodiments, each respective first pin in the one or more first pins is inserted into a corresponding first slot in the one or more first slots of the second bar and a corresponding second slot in the one or more second slots of the button, and movable along the corresponding first slot and the corresponding second slot, thereby allowing the button to move relative to the second bar in the first direction. Movement of the button relative to the second bar in the first direction causes the one or more first pins to move along the one or more first slots of the second bar in the second direction, thereby allowing the one or more coupling members of the first component to engage with or disengage from the one or more first pins of the second component of the locking mechanism.

In an exemplary embodiment, the one or more openings of the second bar include a first opening and a second opening. The one or more coupling members of the first component of the locking mechanism include a first coupling member insertable into the first opening of the second bar and a second coupling member insertable into the second opening of the second bar.

In another exemplary embodiment, the one or more openings of the second bar include a first opening. The one or more coupling members of the first component of the locking mechanism include a first coupling member and a second coupling member, both insertable into the first opening of the second bar.

In some exemplary embodiments, a coupling member in the one or more coupling members of the first component of the locking mechanism includes a hook.

In some exemplary embodiments, the second bar includes two first slots disposed side by side along the second direction. The button of the second component of the locking mechanism includes two second slots. The second component of the locking mechanism includes two first pins each inserted into one of the two first slots and one of the two second slots.

In some exemplary embodiments, each of the one or more second slots of the button is oblique to the first direction at an angle of about 45°, or about 135°.

In an exemplary embodiment, the second bar includes two openings and two first slots. The first component of the locking mechanism includes two coupling members each insertable into one of the two openings of the second bar. The button of the second component of the locking mechanism includes two second slots. The second component of the locking mechanism includes two first pins each inserted into one of the two first slots and one of the two second slots. A first cavity is formed at the button between the two second slots. An elastic member is accommodated at least in part in the first cavity, the elastic member having a first end abutting the first side of the second bar and a second end abutting the button, thereby holding the button at a position, in the absence of any external force, that is away from the first bar.

In another exemplary embodiment, the second bar includes a first opening and two first slots. The first component of the locking mechanism includes two coupling members, both insertable into the first opening of the second bar. The button of the second component of the locking mechanism includes two second slots. The second component of the locking mechanism includes two first pins each inserted into one of the two first slots and one of the two second slots. Two first cavities are formed at the button, where the two second slots are disposed between the two first cavities. A first elastic member is accommodated at least in part in one of the two first cavities and a second elastic member is accommodated at least in part in the other of the two first cavities, each of the first and second elastic members having a first end abutting the first side of the second bar and a second end abutting the button, thereby holding the button at a position, in the absence of any external force, that is away from the first bar.

In some exemplary embodiments, the button includes one or more second cavities for accommodating the one or more coupling members of the first component of the locking mechanism.

In some exemplary embodiments, the supporting assembly includes a protecting component connected to the second bar and the first component of the locking mechanism. The protecting component encompasses the one or more openings of the second bar and the one or more coupling members of the first component of the locking mechanism, thereby ensuring safe use of the locking mechanism.

In some exemplary embodiments, the first component of the locking mechanism includes a third slot elongated in the first direction. The protecting component includes a plurality of segments connected to each other and movable relative to each other along the first direction. A first segment in the plurality of segments is sleeved on the first component of the locking mechanism, and a second segment in the plurality of segments is connected to the second bar. A second pin is disposed at the first segment and inserted into the third slot of the first component of the locking mechanism. The second pin is movable along the third slot, thereby allowing the first segment to move relative to the first component of the locking mechanism along the first direction within a range.

In some exemplary embodiments, the second segment includes a fourth slot at a side facing the first component of the locking mechanism to accommodate the second pin.

In some exemplary embodiments, the first and second segments are connected to each other through one or more segments between the first and second segments.

In various embodiments, the present disclosure provides a foldable structure including a first longitudinal mounting member and a second longitudinal mounting member, and a pair of supporting assemblies of the present disclosure. In some exemplary embodiments, the first bar of one supporting assembly is rotatably connected to the first and second longitudinal mounting members at a first side of the foldable structure and the first bar of the other supporting assembly is rotatably connected to the first and second longitudinal mounting members at a second side of the foldable structure.

In some exemplary embodiments, the foldable structure further includes a plurality of links, each having a first end pivotally connected to the outer bar of the first or second leg of a supporting assembly in the pair of supporting assemblies and a second end pivotally connected to the first or second longitudinal mounting member.

The supporting assemblies and tables of the present disclosure have other features and advantages that will be apparent from, or are set forth in more detail in, the accompanying drawings, which are incorporated herein, and the following Detailed Description, which together serve to explain certain principles of exemplary embodiments of the present disclosure.

BRIEF DESCRIPTION OF THE DRAWINGS

The accompanying drawings, which are incorporated into and constitute a part of this specification, illustrate one or more exemplary embodiments of the present disclosure and, together with the Detailed Description, serve to explain the principles and implementations of exemplary embodiments of the invention.

DETAILED DESCRIPTION

Figure 1:
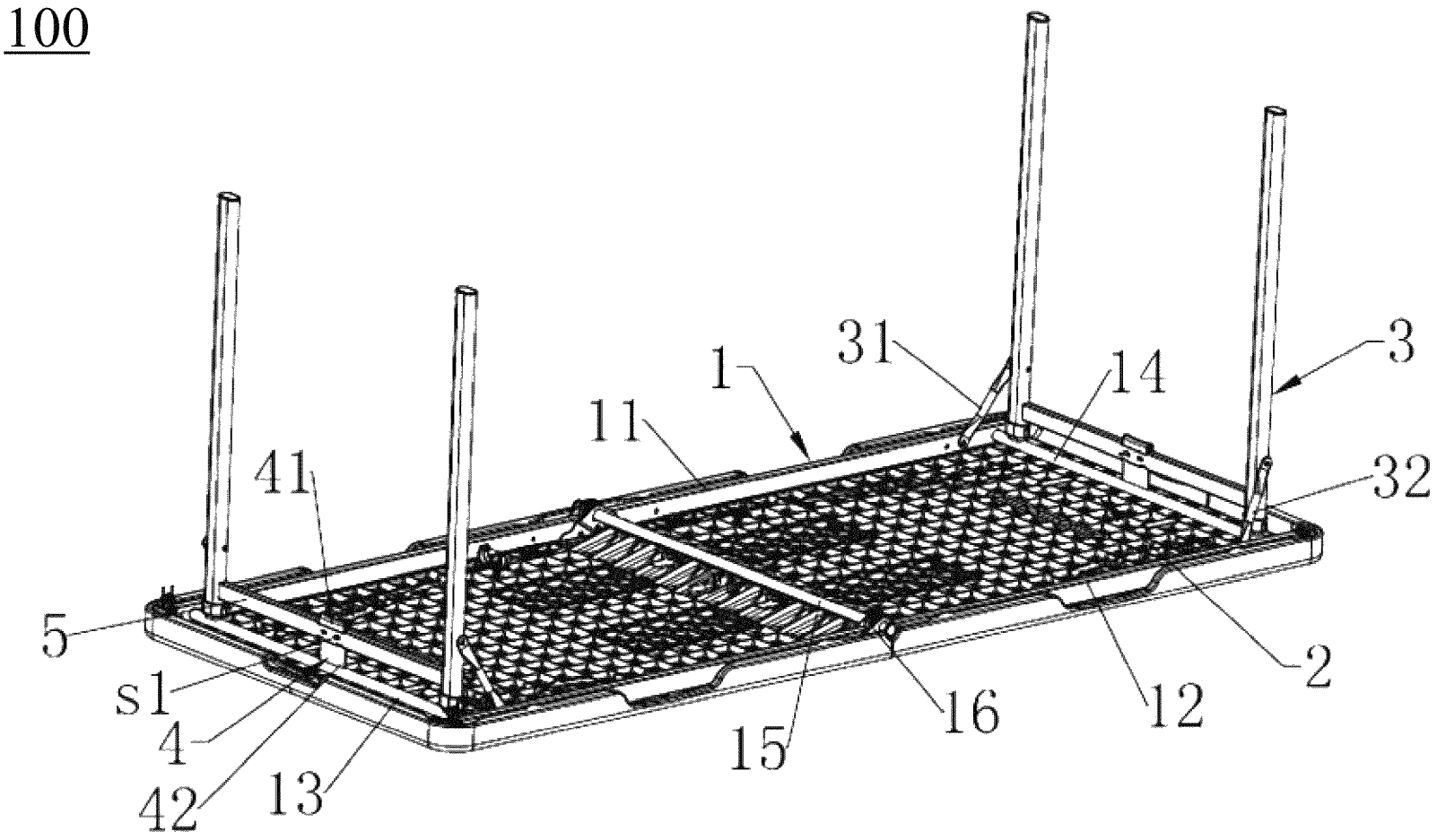
FIG. 1 is a bottom perspective view illustrating an exemplary table, where leg assemblies are in an unfolded state, in accordance with some exemplary embodiments of the present disclosure.

The present disclosure provides supporting assemblies and foldable structures (e.g., foldable frames, foldable tables, foldable benches, foldable beds) having such supporting assemblies that are simple, safe and convenient to use. A supporting assembly includes a locking mechanism that is easy to operate. It can lock the supporting assembly in an unfold state to prevent inadvertent folding of the supporting assembly. The locking mechanism can be unlocked easily when folding the supporting assembly is desired. In some exemplary embodiments, the supporting assembly also includes a protecting component configured to enhance safety during the operation of the locking mechanism.

Reference will now be made in detail to implementation of exemplary embodiments of the present disclosure as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present disclosure will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the exemplary embodiments set forth in this disclosure can be made without departing from the spirit and scope of the exemplary embodiments, as will be apparent to those skilled in the art. The specific exemplary embodiments described herein are offered by way of example only, and the disclosure is to be limited only by the terms of the appended claims, along with the full scope of equivalents to which such claims are entitled.

As used herein, the term "about", "approximately", or "substantially" can mean within an acceptable error range for the particular value as determined by one of ordinary skill in the art, which can depend in part on how the value is measured or determined, e.g., the limitations of the measurement system. For example, "about" can mean within 1 or more than 1 standard deviation, per the practice in the art. "About" can mean a range of +20%, +10%, +5%, or +1% of a given value. Where particular values are described in the application and claims, unless otherwise stated, the term "about" means within an acceptable error range for the particular value. The term "about" can have the meaning as commonly understood by one of ordinary skill in the art. The term "about" can refer to +10%. The term "about" can refer to +5%.

Figure 4:
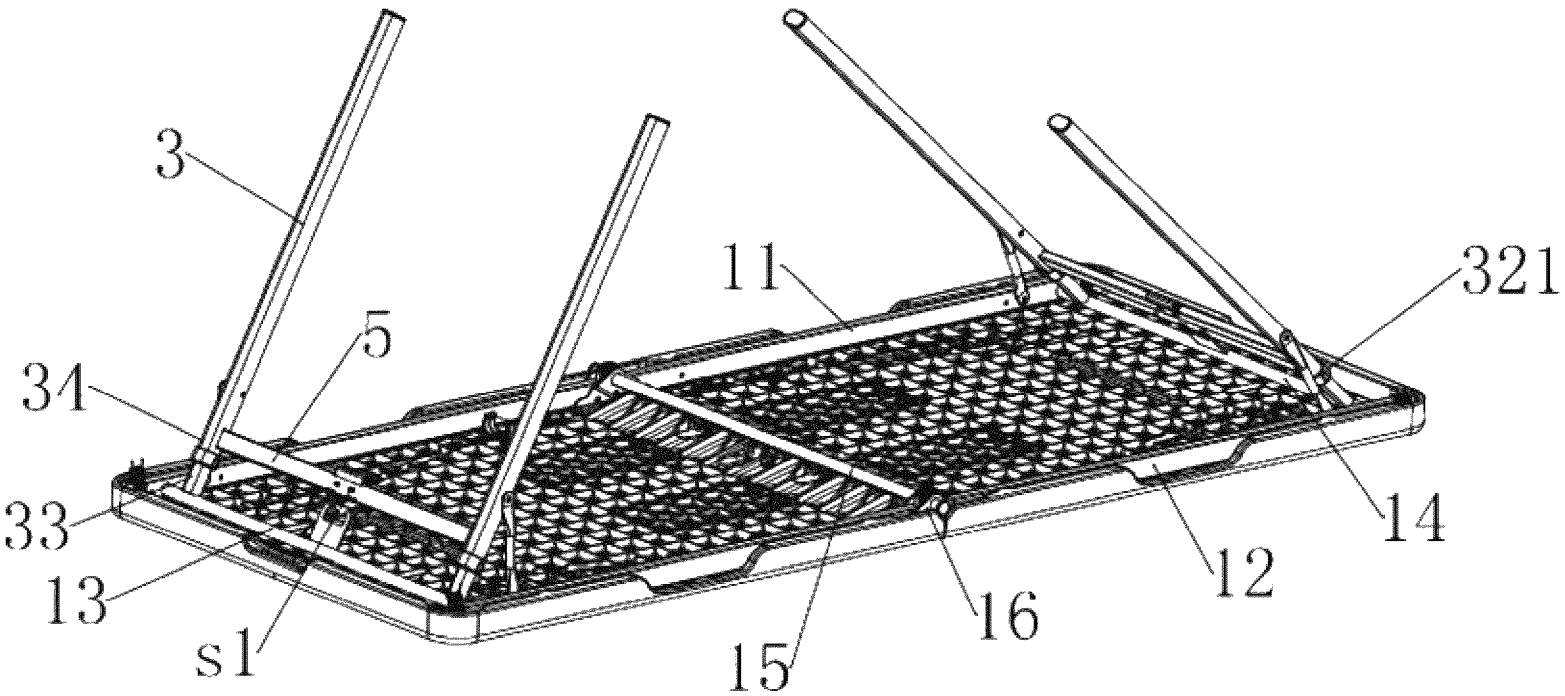
FIG. 4 is a bottom perspective view illustrating the exemplary table of FIG. 1, wherein leg assemblies are in an intermediate state, in accordance with some exemplary embodiments of the present disclosure.
Figure 7:
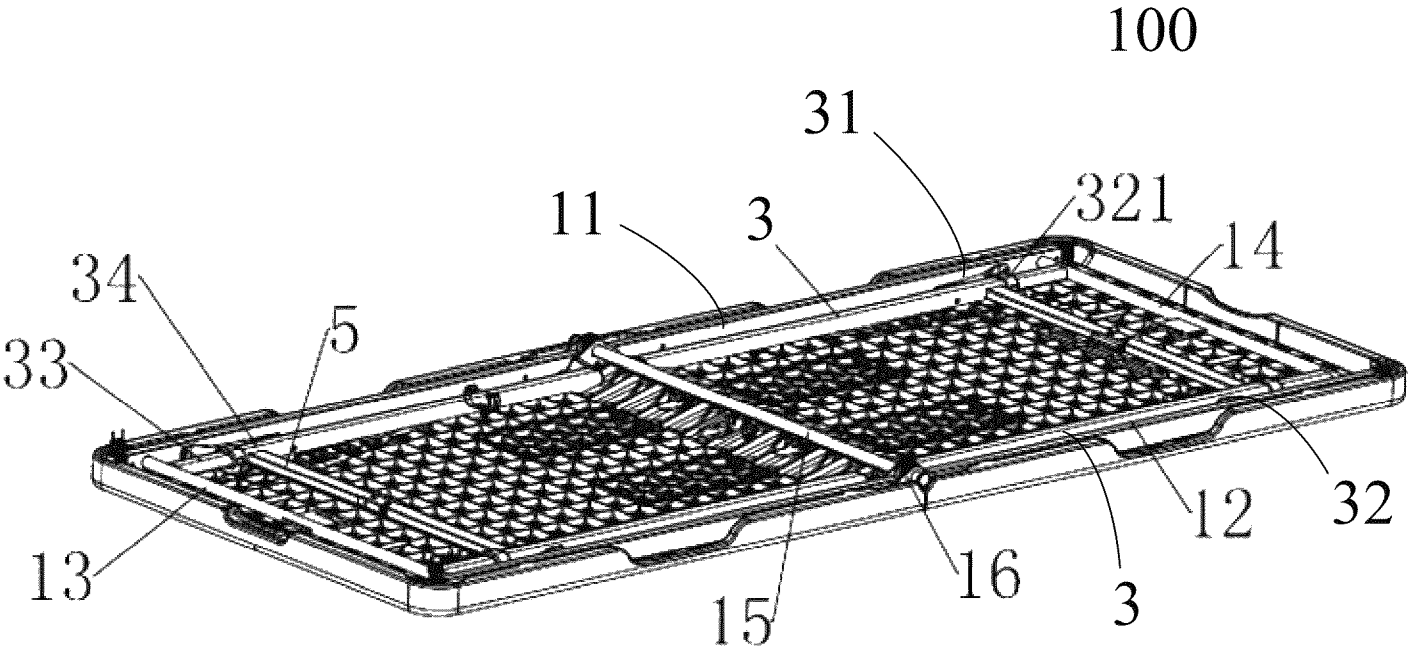
FIG. 7 is a bottom perspective view illustrating the exemplary table of FIG. 1, wherein leg assemblies are in a folded state, in accordance with some exemplary embodiments of the present disclosure.

Referring to FIGS. 1, 4 and 7, there is depicted a foldable table, generally designated 100, in accordance with some exemplary embodiments of the present disclosure. Foldable table 100 includes a mounting frame, a table panel, a plurality of legs and one or more locking mechanisms. For instance, in some exemplary embodiments, foldable table 100 includes mounting frame 1, table panel 2, legs 3 and locking mechanism(s) 4.

In some exemplary embodiments, mounting frame 1 includes a plurality of longitudinal mounting bars, such as first longitudinal mounting bar 11 and second longitudinal mounting bar 12. The first and second longitudinal mounting bars can be but do not necessarily have to be identical or symmetric with respect to each other. As a non-limiting example, the first and second longitudinal mounting bars are illustrated to be substantially the same and symmetric with respect to each other. In some exemplary embodiments, the first and second longitudinal mounting bars are spaced apart from each other in a lateral direction of the table. In some exemplary embodiments, each of the first and second longitudinal mounting bars includes a first bar segment and a second bar segment pivotally connected to each other at their proximal ends, for instance, by a pivoting mechanism, such as pivoting mechanism 16.

In some exemplary embodiments, mounting frame 1 also includes a plurality of lateral mounting bars, such as first lateral mounting bar 13 and second lateral mounting bar 14. The first and second lateral mounting bars can be but do not necessarily have to be identical or symmetric with respect to each other. As a non-limiting example, the first and second lateral mounting bars are illustrated to be substantially the same and symmetric with respect to each other. In some exemplary embodiments, the first and second lateral mounting bars are spaced apart from each other in a longitudinal direction of the table, each connected to the first and second longitudinal mounting bars.

In some exemplary embodiments, an intermediate lateral bar 15 is provided. One end of the intermediate lateral bar is connected to the first longitudinal mounting bar or the pivoting mechanism that connects the bar segments of the first longitudinal mounting bar. Another end of the intermediate lateral bar is connected to the second longitudinal mounting bar or the pivoting mechanism that connects the bar segments of the second longitudinal mounting bar.

In some exemplary embodiments, table panel 2 includes a first panel segment and a second panel segment, which can be but do not necessarily have to be identical or symmetric with respect to each other. In some exemplary embodiments, the first panel segment is coupled with the first bar segments of the first and second longitudinal mounting bars while the second panel segment is coupled with the second bar segments of the first and second longitudinal mounting bars. This allows the table to be folded in half.

In some exemplary embodiments, the table panel or each of the first and second panel segments is a unitary piece formed by blow molding plastics such as high density polyethylene (HDPE), low density polyethylene (LDPE), polypropylene (PP), polyvinyl chloride (PVC), polyethylene terephthalate (PET), thermoplastic elastomers (TPE), or the like. The panel or a panel segment generally includes a first panel wall, a second panel wall and a generally hollow interior formed between the first and second panel walls. The panel or a panel segment can be of various regular or irregular shapes, including but not limited to a square shape, a half circular shape or a rectangular shape. The panel or a panel segment can have other features, such as depressions, ridges, or the like, monolithically formed with the first and/or second panel walls.

The plurality of legs 3 is connected to the mounting frame. For instance, in some exemplary embodiments, each leg has an end connected to either first lateral mounting bar 13 or second lateral mounting bar 14 and another end configured to abut a surface, such as a ground surface, when the table is in use. In an exemplary embodiment, the first or second lateral mounting bar is pivotally connected to the first and second longitudinal mounting bars, thereby allowing the leg to rotate relative to the first and second longitudinal mounting bars and thus to fold/unfold relative to the table panel. In another exemplary embodiment, the first or second lateral mounting bar is fixedly connected to the first and second longitudinal mounting bars while the leg has an end pivotally connected to the first or second lateral mounting bar. As such, the leg can rotate relative to the first and second longitudinal mounting bars and thus fold/unfold relative to the table panel.

In some exemplary embodiments, a pair of legs is connected to each of the first and second lateral mounting bars. In some such embodiments, a lateral bar, such as lateral bar 5, is connected to both legs. For instance, the lateral bar is disposed between the two legs, with one end connected to one leg and the other end connected to the other leg. In an exemplary embodiment, lateral bar 5 is substantially parallel to the first or second lateral mounting bar.

In some exemplary embodiments, a leg is also connected to the first or second longitudinal mounting bar by a link, such as link 31 or link 32. For instance, in an exemplary embodiment, link 31 has an end pivotally connected to a leg and another end pivotally connected to the first longitudinal mounting bar. Similarly, link 32 has an end pivotally connected to a leg and another end pivotally connected to the second longitudinal bar. In some exemplary embodiments, each link is disposed on an exterior side of a leg and an interior side of a longitudinal mounting bar along a lateral direction of the table. As such, when the leg is folded as illustrated in FIG. 7, the link is disposed between the leg and the longitudinal mounting bar. For instance, link 31 is disposed between a leg and the first longitudinal mounting bar 11 and link 32 is disposed between a leg and the second longitudinal mounting bar 12 when the legs are folded to the table panel. This reduces the size of the table when folded and thus requires less storage space.

Figure 2:
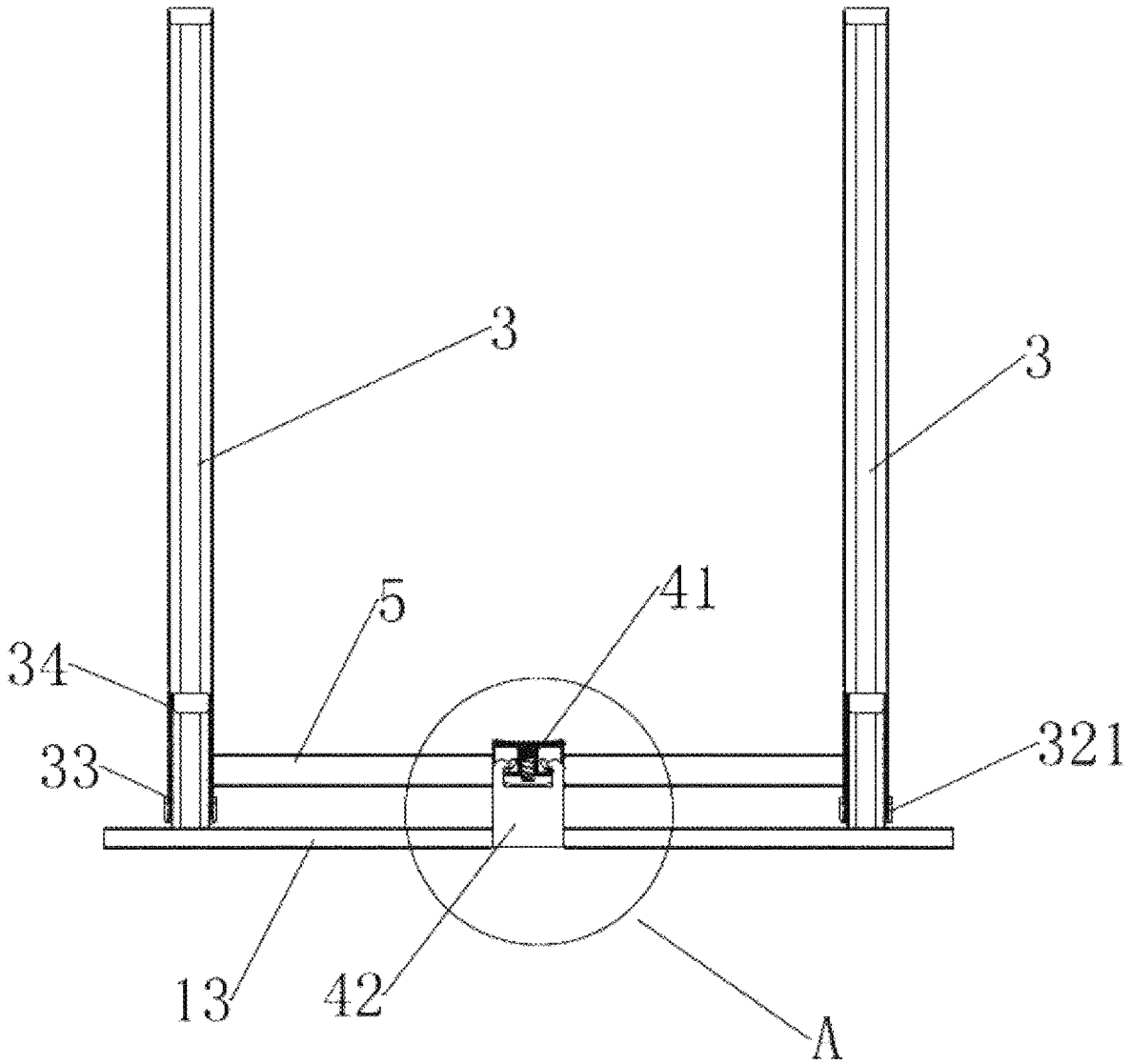
FIG. 2 is a sectional view illustrating a supporting assembly of the exemplary table of FIG. 1 in accordance with some exemplary embodiments of the present disclosure.
Figure 2:
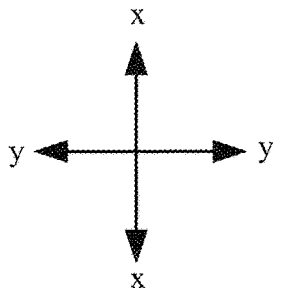
Figure 5:
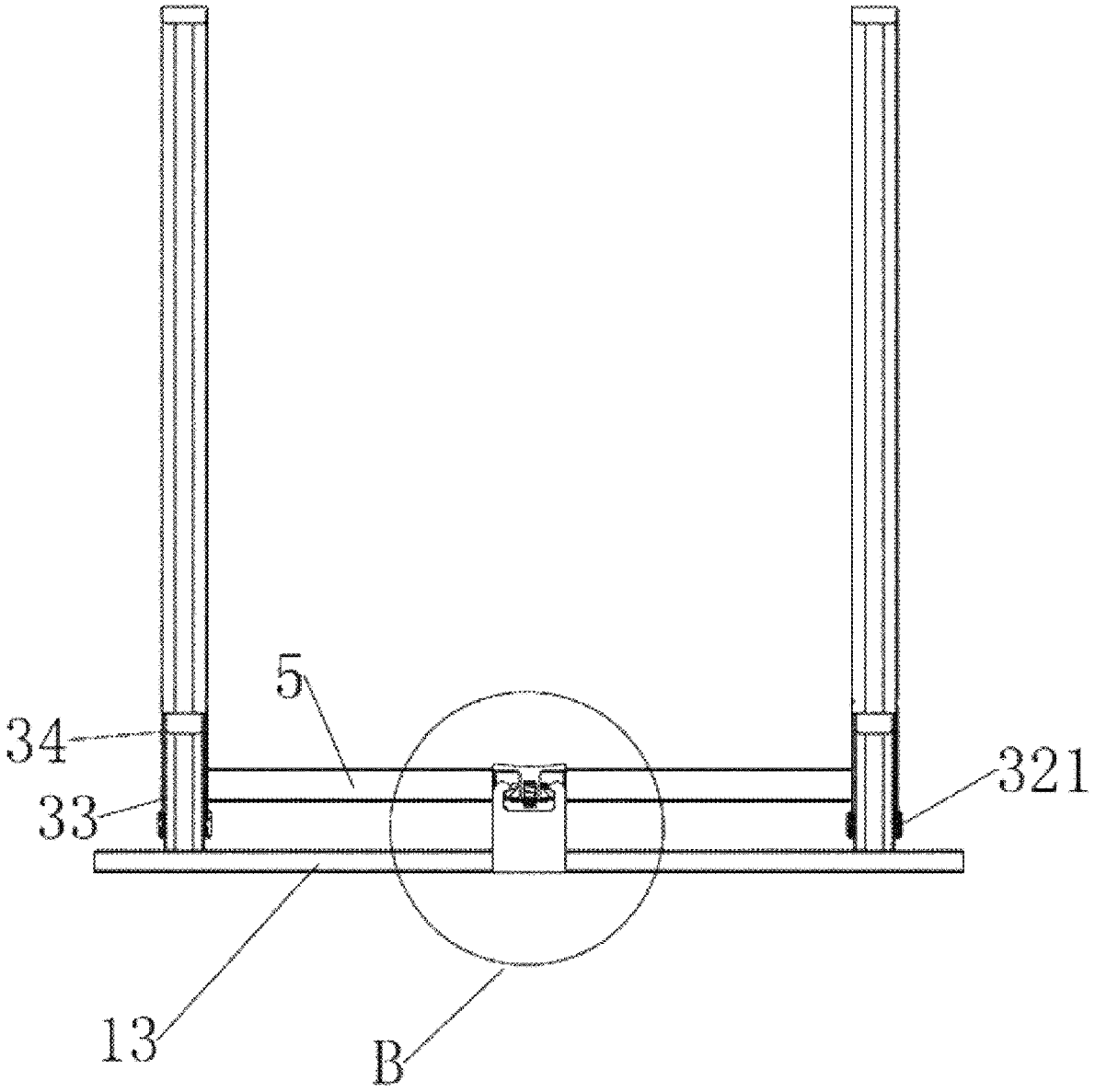
FIG. 5 is a sectional view illustrating a supporting assembly of the exemplary table of FIG. 4 in accordance with some exemplary embodiments of the present disclosure.
Figure 8:
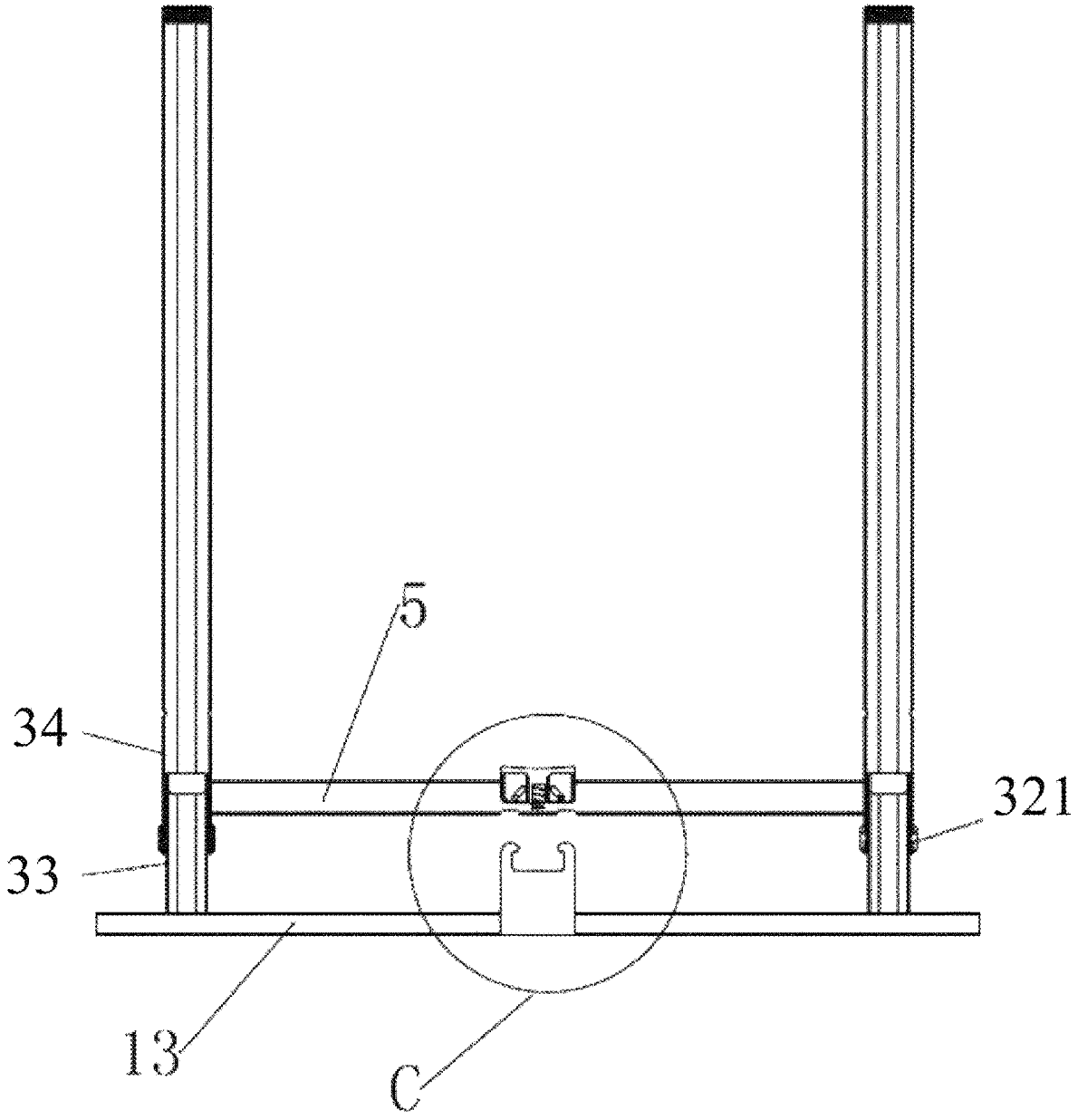
FIG. 8 is a sectional view illustrating a supporting assembly of the exemplary table of FIG. 7 in accordance with some exemplary embodiments of the present disclosure.

Referring to FIGS. 2, 5 and 8, there is depicted an exemplary supporting assembly, generally designated 200, in accordance with some exemplary embodiments of the present disclosure. Supporting assembly 200 includes a first bar (e.g., first lateral mounting bar 13 or second lateral mounting bar 14), a second bar (e.g., lateral bar 5), a pair of legs 3, and locking mechanism 4.

In some exemplary embodiments, each leg includes an inner bar, such as inner bar 33, and an outer bar, such as outer bar 34. The inner and outer bars are movably coupled with each other, e.g., movable along a length direction of the leg, indicated in FIG. 2 by the arrows "x" and referred herein as the first direction. For instance, in an exemplary embodiment, each of the inner and outer bars includes a proximal end and a distal end. As used herein, the proximal end of the outer bar refers to its end portion located relatively closer to the inner bar and the distal end refers to its end portion located relatively away from the inner bar. Similarly, the proximal end of the inner bar refers to its end portion located relatively closer to the outer bar and the distal end of the inner bar refers to its end portion located relatively away from the outer bar.

In some exemplary embodiments, at least a portion of the outer bar is hollow, and at least a portion of the inner bar is inserted into the outer bar. For instance, in an exemplary embodiment, the proximal end of the inner bar is disposed inside the outer bar, and the distal end of the inner bar is connected to the first bar (e.g., first lateral mounting bar 13 or second lateral mounting bar 14). The distal end of the outer bar is configured to abut a surface such as a ground surface when the table is in use.

Locking mechanism 4 is configured to control the relative movement of the inner and outer bars of leg 3. In some exemplary embodiments, the locking mechanism includes a first component, such as first component 42, and a second component, such as second component 41. The first component of the locking mechanism is disposed at the first bar. The second component of the locking mechanism is disposed at the second bar. The first and second components of the locking mechanism are operable to selectively engage with each other or disengage from each other. For instance, in some exemplary embodiments, the first component of the locking mechanism includes a tongue and the second component of the locking mechanism includes a buckle configured to engage with the tongue. Engagement of the first and second components of the locking mechanism prevents relative movement of the inner and outer bars of the legs.

Disengagement of the first and second components of the locking mechanism on the other hand allows relative movement of the inner and outer bars of the legs.

Figure 3:
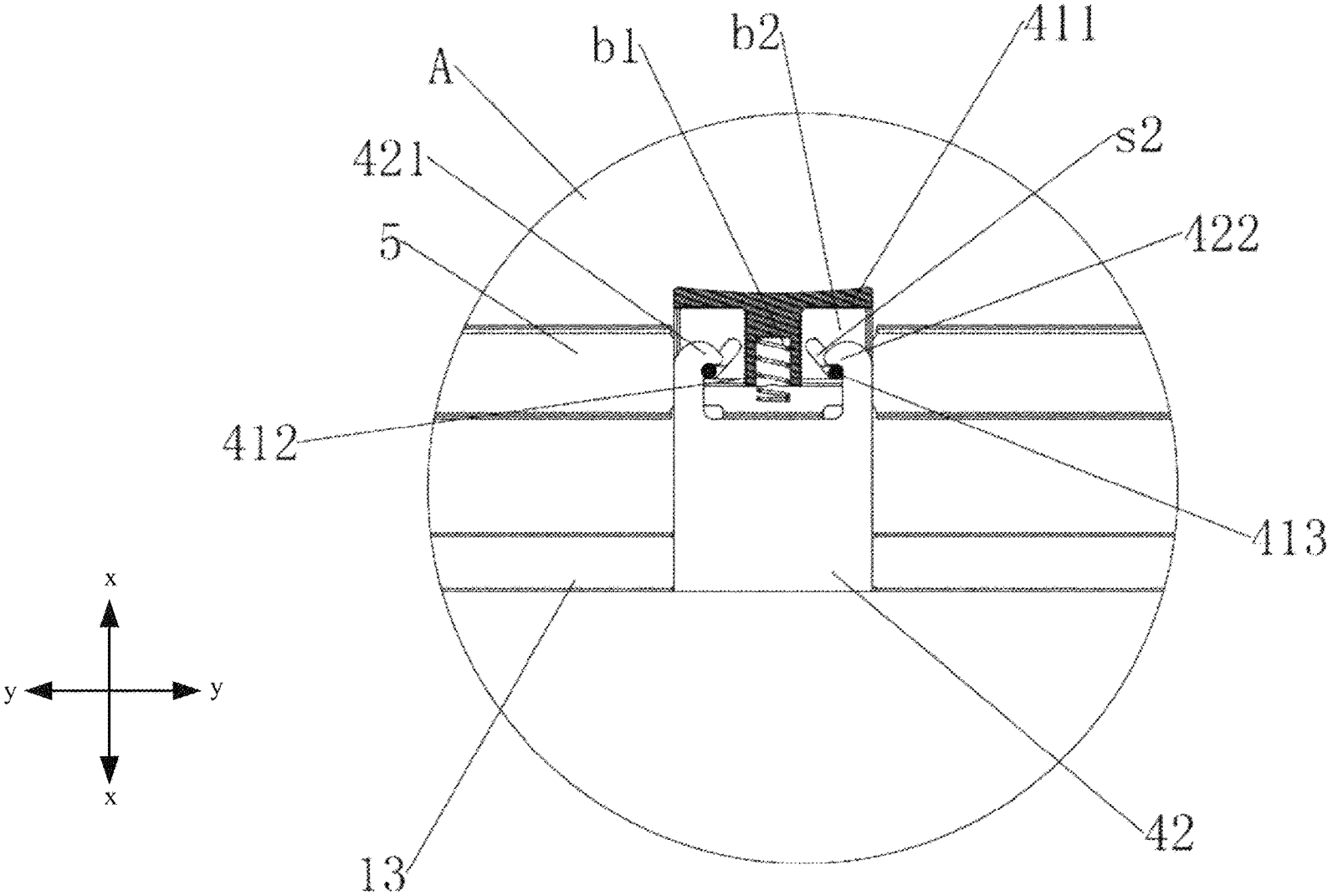
FIG. 3 is an enlarged view taken along circle A of FIG. 2.
Figure 6:
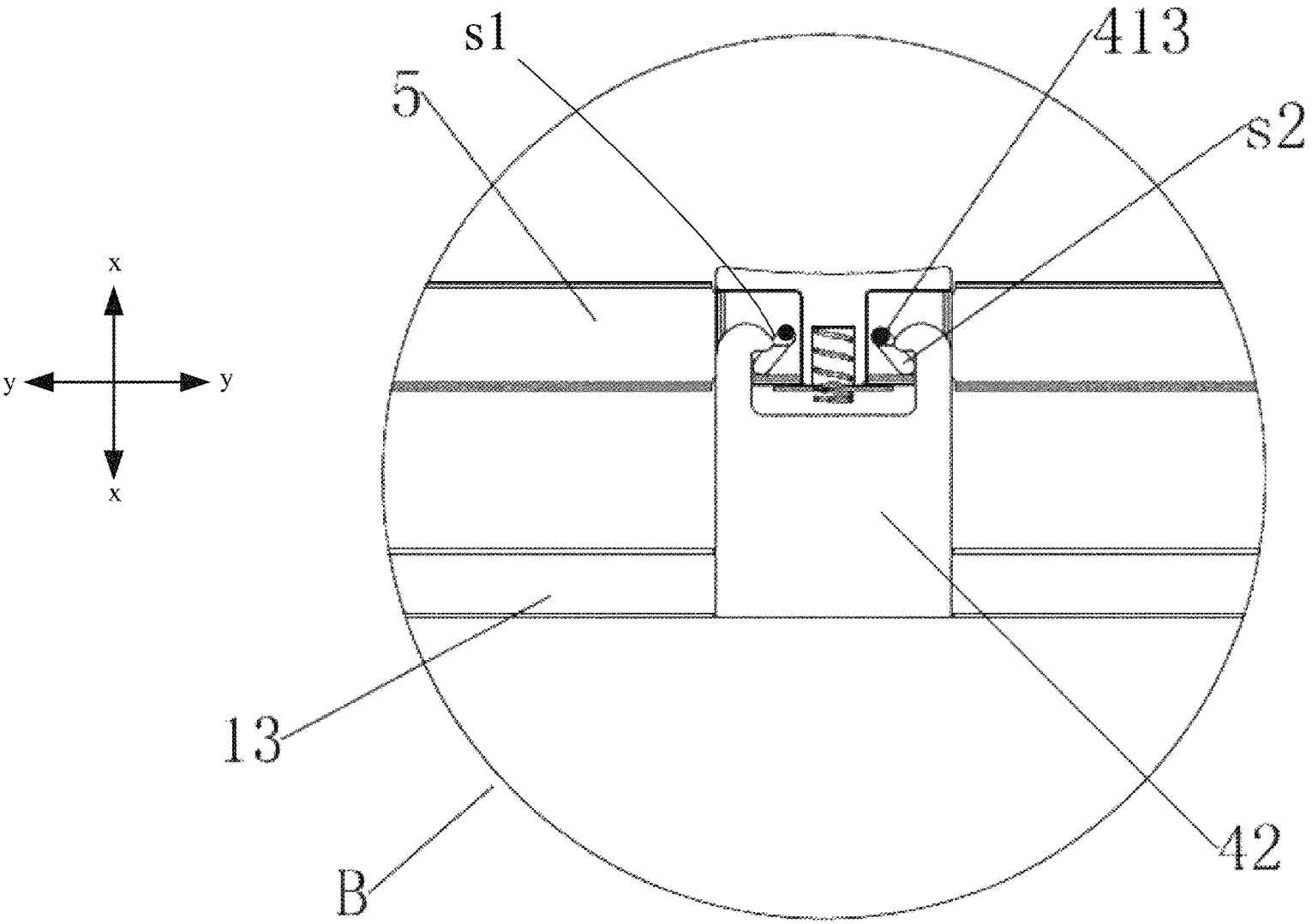
FIG. 6 is an enlarged view taken along circle B of FIG. 5.
Figure 9:
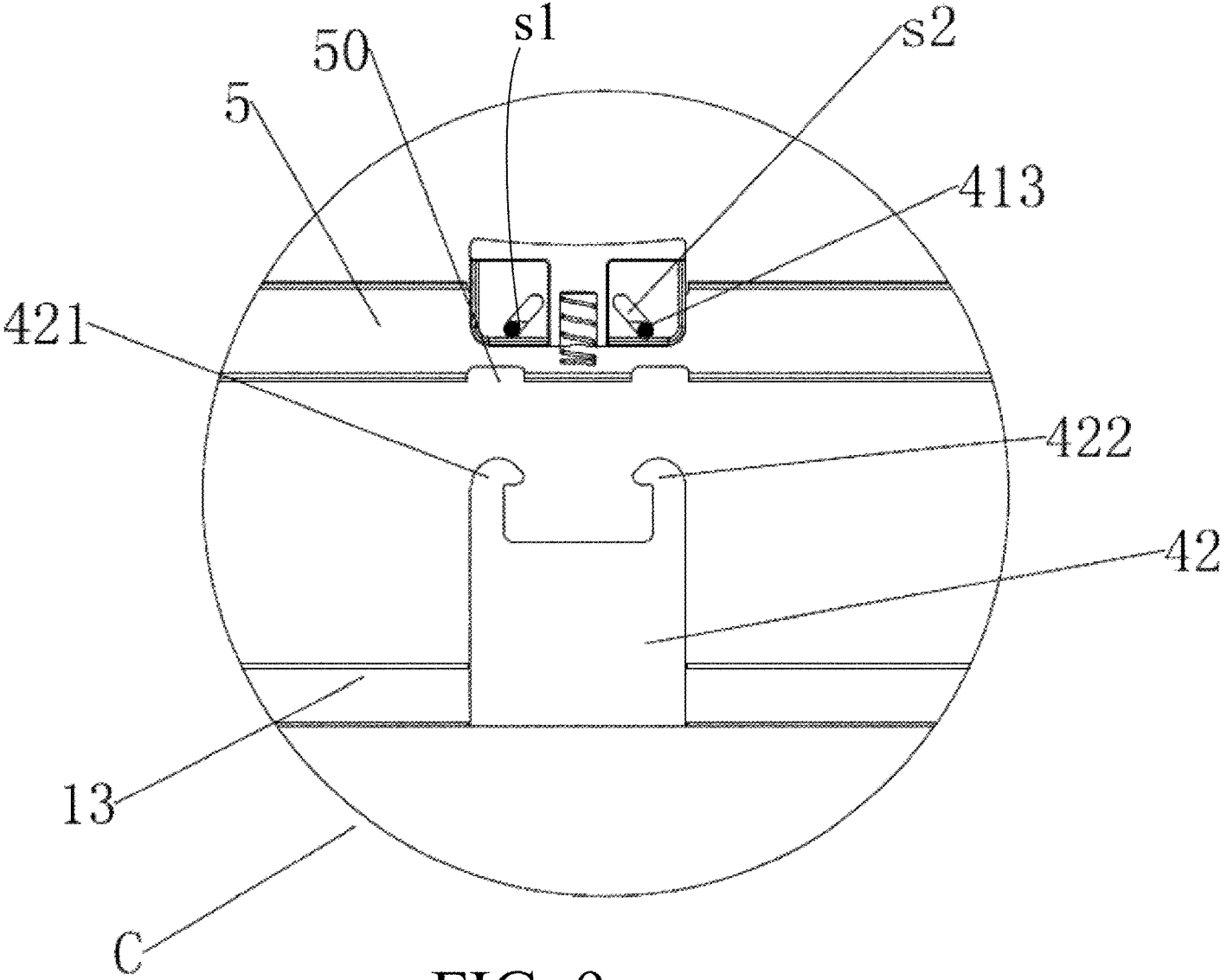
FIG. 9 is an enlarged view taken along circle C of FIG. 8.
Figure 10:
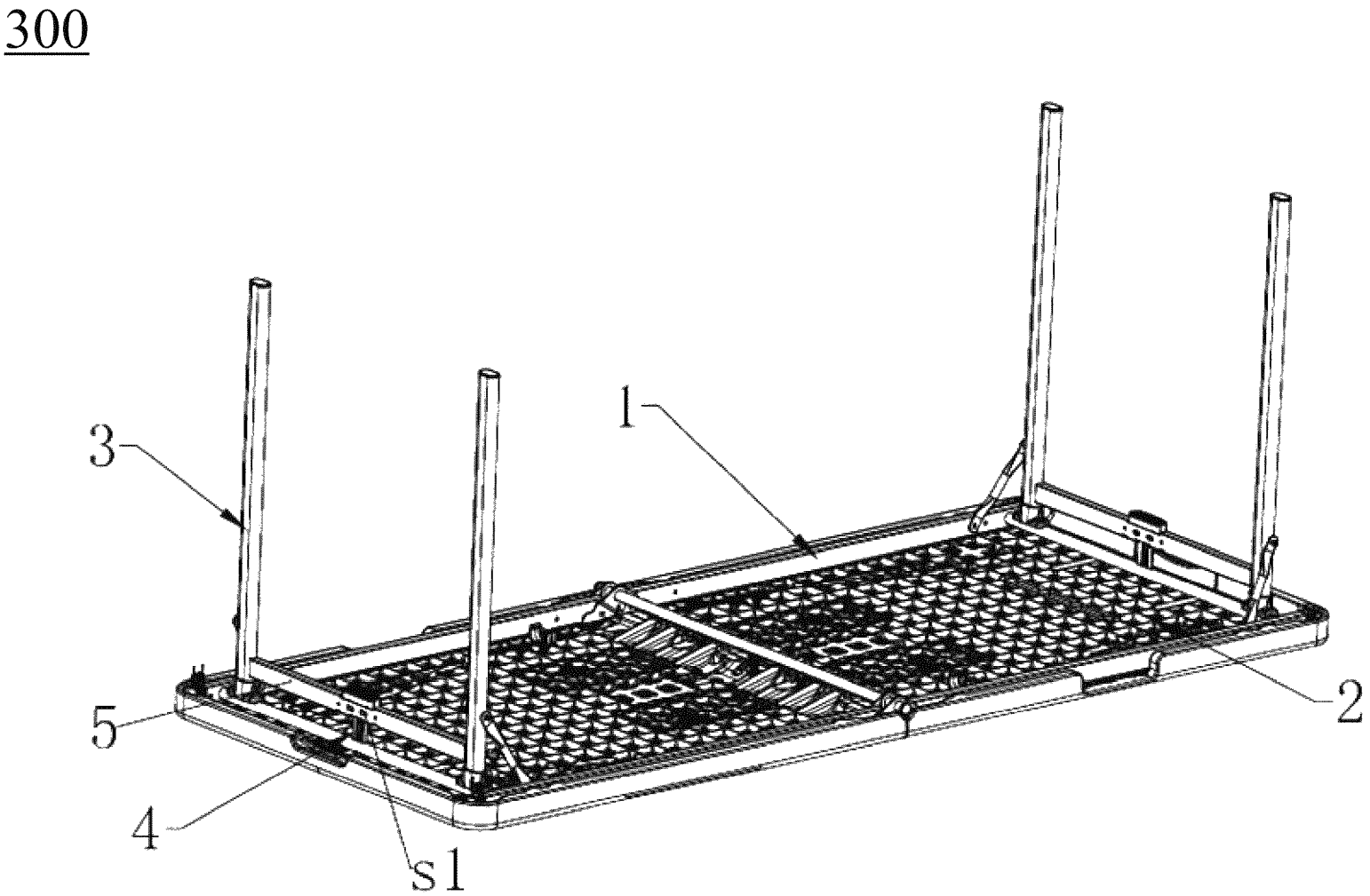
FIG. 10 is a bottom perspective view illustrating an exemplary table, where leg assemblies are in an unfolded state, in accordance with some exemplary embodiments of the present disclosure.

Referring to FIGS. 3, 6 and 9, in some exemplary embodiments, the second bar (i.e., lateral bar 5) includes one or more openings, such as opening 50, and one or more first slots, such as first slot s1. The one or more openings are formed on a first side of the second bar generally facing the first bar (e.g., first lateral mounting bar 13 or second lateral mounting bar 14). The one or more first slots are formed on a second side of the second bar, which in some cases is substantially perpendicular to the first side of the second bar. Each of the one or more first slots is elongated in a second direction (e.g., the y-direction in FIG. 9). The second direction generally corresponds to the lateral direction of the table as illustrated in FIGS. 1 and 4, and substantially perpendicular to the first direction (e.g., the x-direction or the length direction of the leg). In some exemplary embodiments, the second bar includes two openings 50, which can be but do not have to be the same as each other. In some exemplary embodiments, the second bar includes two first slots s1, which can be but do not have to be the same as each other.

First component 42 of the locking mechanism includes one or more coupling members, such as coupling member 421 and/or coupling member 422, insertable into the one or more openings of the second bar. The number of the one or more coupling members can be but do not have to be the same as the number of the one or more openings of the second bar. For instance, in an exemplary embodiment, an opening is configured for inserting one coupling member. In another exemplary embodiment, an opening is configured for inserting two coupling members. In still another exemplary, an opening is not configuring for inserting any of the one or more coupling members. As a non-limiting example, FIGS. 3, 6 and 9 illustrate that the first component of the locking mechanism includes two coupling members each insertable into one opening of the second bar. A coupling member in the one or more coupling members of the first component of the locking mechanism can be a latch, a clasp, clip, a hook, a catch, a buckle, or the like.

Second component 41 of the locking mechanism includes a button, such as button 411, and one or more first pins, such as first pin 413. The button includes one or more second slots, such as second slot s2, corresponding to the one or more first slots of the second bar. In some exemplary embodiments, each of the one or more second slots is elongated in a direction oblique to both of the first and second directions, e.g., not parallel to either of the first and second directions nor perpendicular to either of the first and second directions. In other words, the first and second slots are oblique to each other at an angle. In some exemplary embodiments, the angle is within a range of from about 15° to about 75° or from about 105° to about 165°. In an exemplary embodiment, the angle is about 45°, or about 135°.

Each respective first pin 413 in the one or more first pins is inserted into a corresponding first slot s1 in the one or more first slots of the second bar and a corresponding second slot s2 in the one or more second slots of the button. The respective first pin is movable along the corresponding first slot and movable along the corresponding second slot. As such, the one or more first pins couple the button with the second bar and allow the button to move relative to the second bar in the first direction (e.g., the x-direction). Moreover, movement of the button relative to the second bar in the first direction causes the one or more first pins to move along the one or more first slots of the second bar in the second direction (e.g., the y-direction).

In some exemplary embodiments, button 411 includes one or more first cavities, such as first cavity b1. The one or more first cavities are configured to accommodate at least in part one or more elastic members, such as elastic member 412. An elastic member may be a string or the like. In some exemplary embodiments, each of the one or more elastic members has an end abutting the first side of the second bar and another end abutting the button. As such, in the absence of any external force, the one or more elastic members hold the button at a position that is away from the first bar (e.g., first lateral mounting bar 13 or second lateral mounting bar 14).

In some exemplary embodiments, button 411 includes one or more second cavities, such as second cavity b2. The one or more second cavities are positioned and/or sized in accordance with the one or more coupling members of the first component of the locking mechanism, the one or more openings of the second bar, and the one or more second slots of the button. The one or more second cavities are configured to accommodate the one or more coupling members of the first component of the locking mechanism.

Referring to FIGS. 1-9 (in particular, FIGS. 3, 6 and 9), in an exemplary embodiment, the second bar (e.g., lateral bar 5) includes two openings 50 and two first slots s1. First component 42 of the locking mechanism includes two coupling members (e.g., coupling member 421 and coupling member 422) each insertable into one of the two openings of the second bar. Second component 41 of the locking mechanism includes button 411, one elastic member 412 and two first pins 413. Button 411 of the second component of the locking mechanism includes two second slots s2, one first cavity b1 and two second cavities b2. The two second slots are disposed side by side along the second direction (e.g., the y-direction in FIG. 6) and corresponding to the two first slots s1. The first cavity is formed between the two second slots, and each of the two second cavities corresponds to one of the two coupling members, one of the two first slots and one of the two second slots. Each of the two first pins is inserted into one of the two first slots and one of the two second slots. The elastic member is accommodated at least in part in the first cavity, and has an end abutting the first side of the second bar and another end abutting the button. As such, in the absence of any external force, the clastic member holds the button at a position that is away from the first bar. While the two openings are illustrated to be substantially the same, it should be noted that they can be but do not have to be the same or symmetric to each other. Similarly, the two first slots, the two coupling members, the two second slots, the two first pins, the two second cavities, etc., can be but do not have to be the same or symmetric to each other.

Referring to FIGS. 10-18 (in particular FIGS. 12, 15 and 18), in another exemplary embodiment, the second bar (e.g., lateral bar 5) includes one opening 50 and two first slots s1. First component 42 of the locking mechanism includes two coupling members (e.g., coupling member 421 and coupling member 422), both insertable into the one opening of the second bar. Second component 41 of the locking mechanism includes button 411, two elastic members 412 and two first pins 413. Button 411 of the second component of the locking mechanism includes two second slots s2, two first cavities b1 and one second cavity b2. The two second slots are disposed side by side along the second direction (e.g., the y-direction in FIG. 18) and corresponding to the two first slots s1. Also, the two second slots are disposed between the two first cavities along the second direction. The second cavity corresponds to the two coupling members, the two first slots and the two second slots. Each of the two first pins is inserted into one of the two first slots and one of the two second slots. Each of the two clastic member is accommodated at least in part in a corresponding first cavity in the two first cavities, and has an end abutting the first side of the second bar and another end abutting the button. As such, in the absence of any external force, the elastic member holds the button at a position that is away from the first bar. While the two first slots, the two coupling members, the two second slots, the two first pins, the two first cavities, etc., are illustrated to be the same and symmetric to each other, it should be noted that this is by way of example and the present disclosure is not limited thereto.

Referring to FIGS. 1-3 and 10-12, when the one or more coupling members of the first component of the locking mechanism are inserted into the one or more second cavities and engaged with the one or more first pins, the first and second components of the locking mechanism are locked with each other. As a result, the inner and outer bars of each leg of the supporting assembly are not allowed to move away from each other, thereby retaining the supporting assembly in an unfolded state, and preventing inadvertent unfolding of the supporting assembly.

In some exemplary embodiments, when the first and second components of the locking mechanism are engaged with each other, the supporting assembly is unfolded and locked. At this state, the proximal end of the outer bar of the leg abuts the first bar, thereby helping to stabilize the legs (e.g., reduce shaking, wobbling) when the table is in use. For instance, as a non-limiting example, FIG. 2 illustrates that the proximal end of the outer bar includes a supporting piece, such as supporting piece 321, abutting the first bar when the supporting assembly is locked by the locking mechanism (e.g., when the supporting assembly is unfolded). In some exemplary embodiments, the supporting piece has a recess (e.g., a groove) to fit on the first bar. The supporting piece helps to stabilize the legs when the table is in use.

Figure 15:
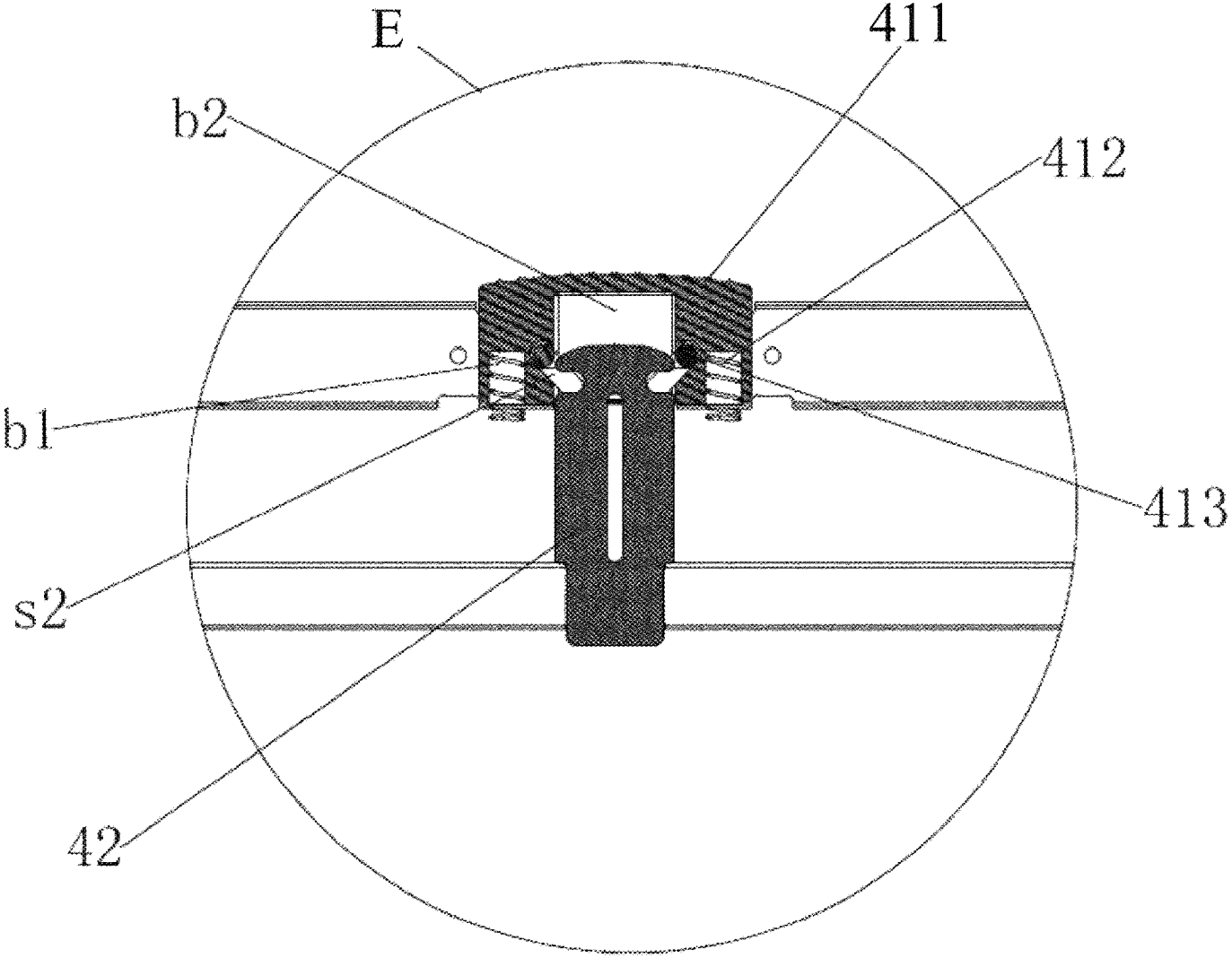
FIG. 15 is an enlarged view taken along circle E of FIG. 14.
Figure 16:
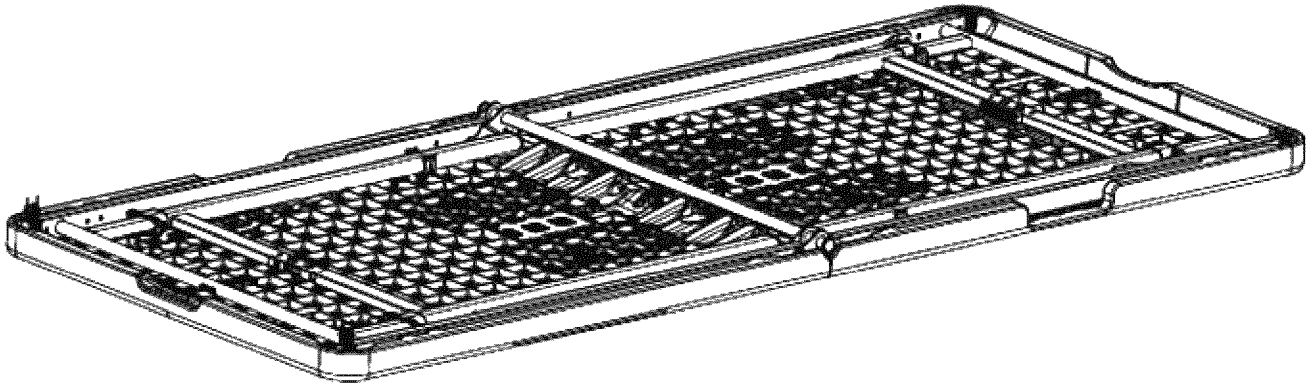
FIG. 16 is a bottom perspective view illustrating the exemplary table of FIG. 10, wherein leg assemblies are in a folded state, in accordance with some exemplary embodiments of the present disclosure.
Figure 17:
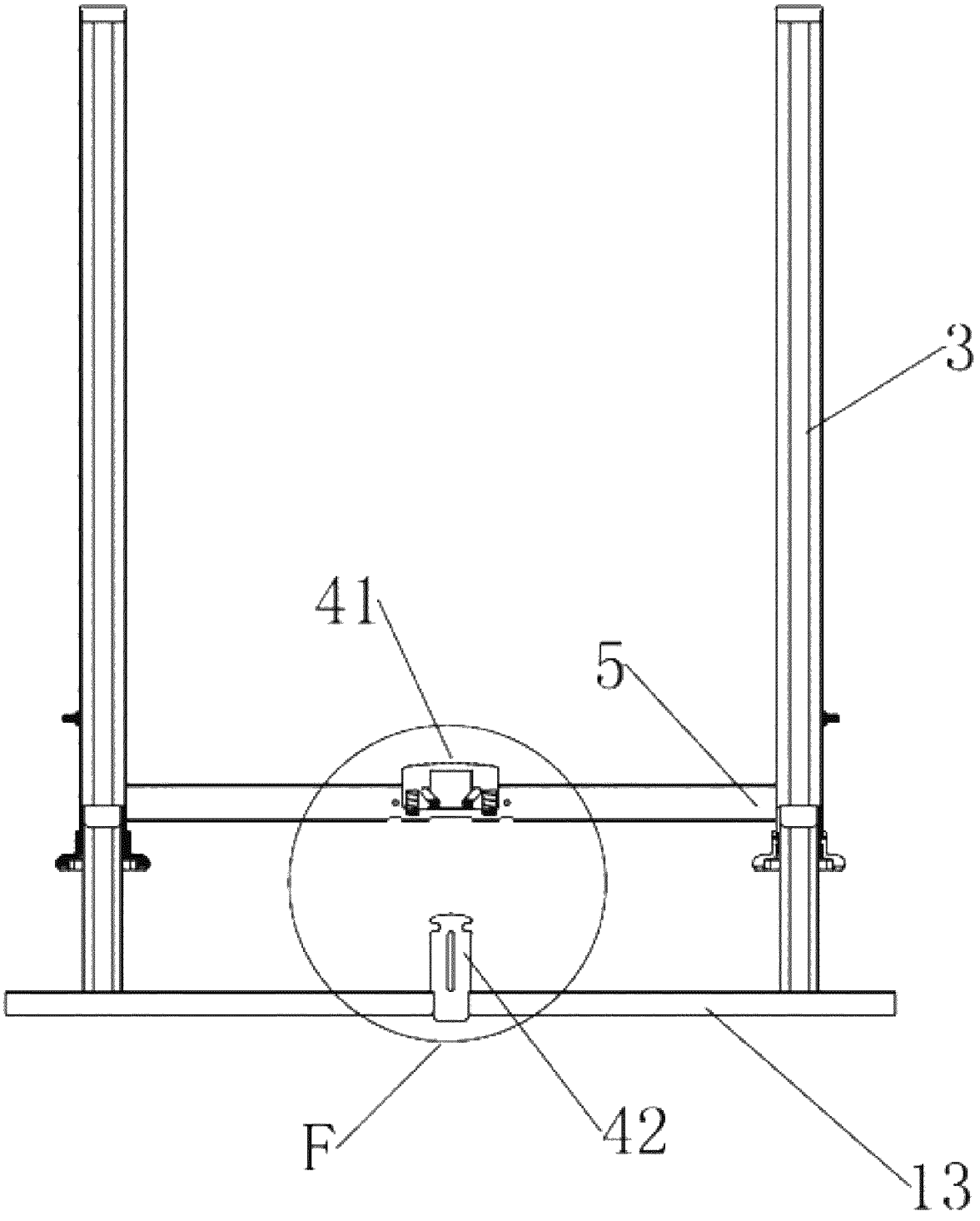
FIG. 17 is a sectional view illustrating a supporting assembly of the exemplary table of FIG. 16 in accordance with some exemplary embodiments of the present disclosure.
Figure 18:
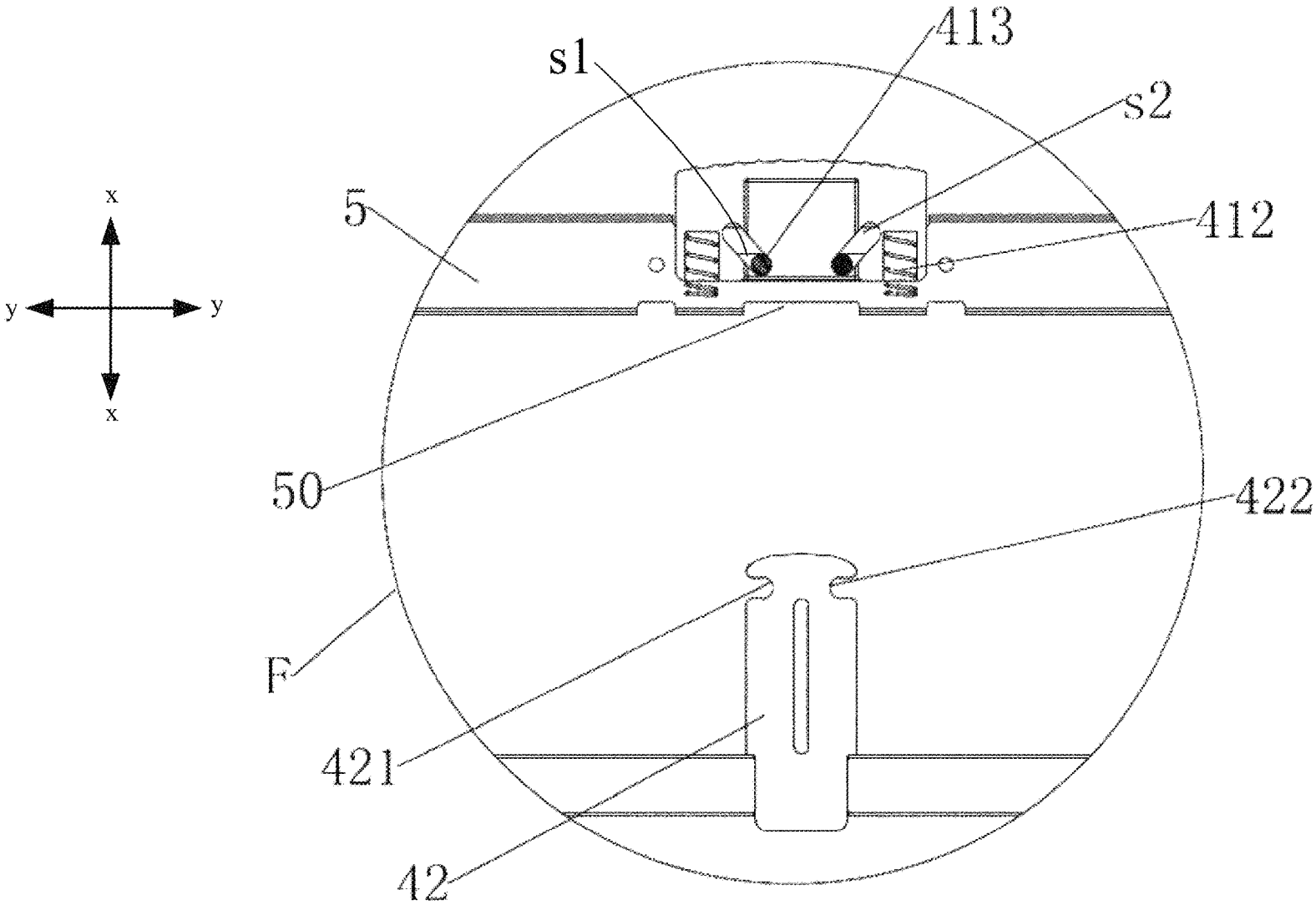
FIG. 18 is an enlarged view taken along circle F of FIG. 17.
Figure 19:
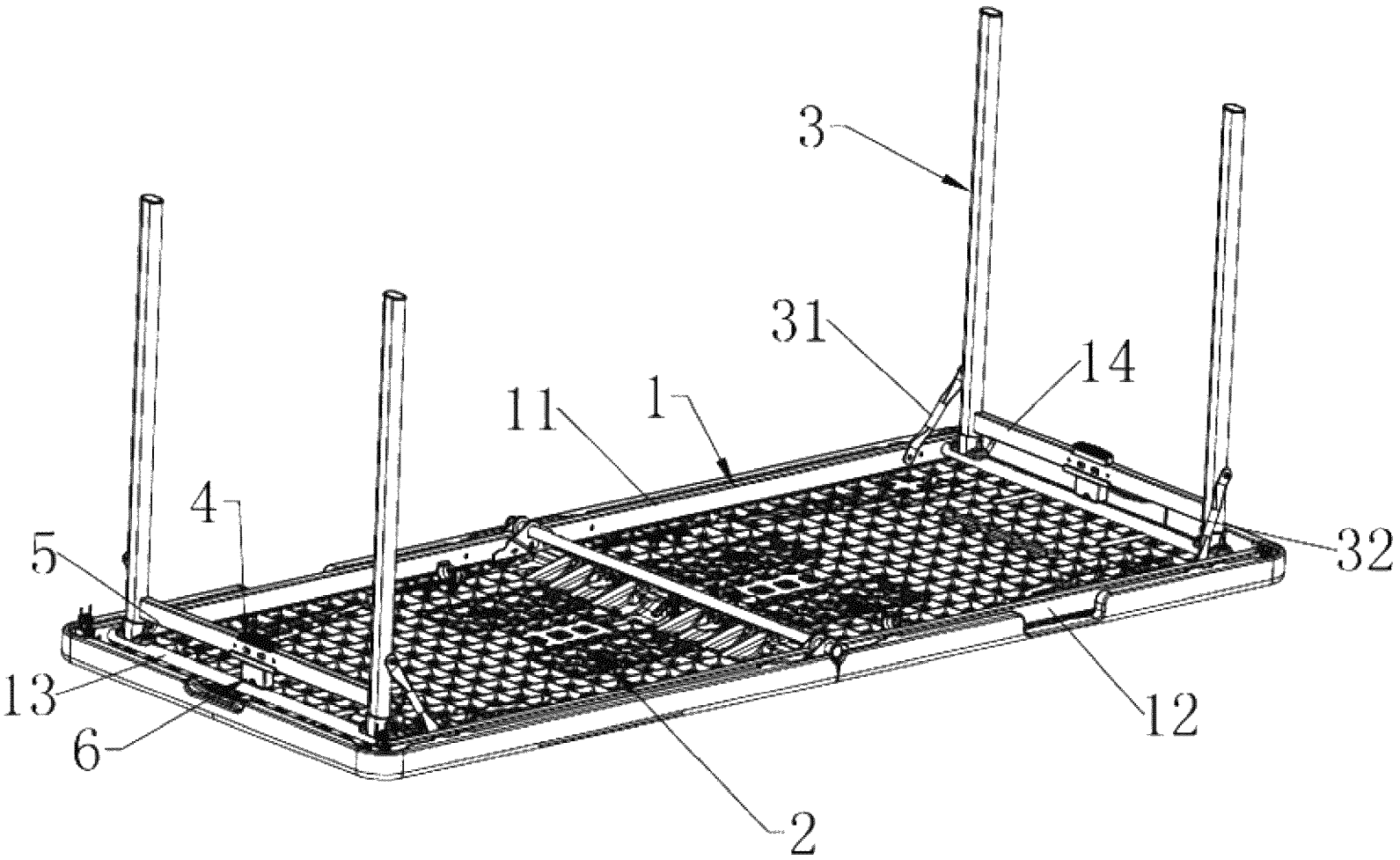
FIG. 19 is a bottom perspective view illustrating an exemplary table, where leg assemblies are in an unfolded state, in accordance with some exemplary embodiments of the present disclosure.
Figure 20:
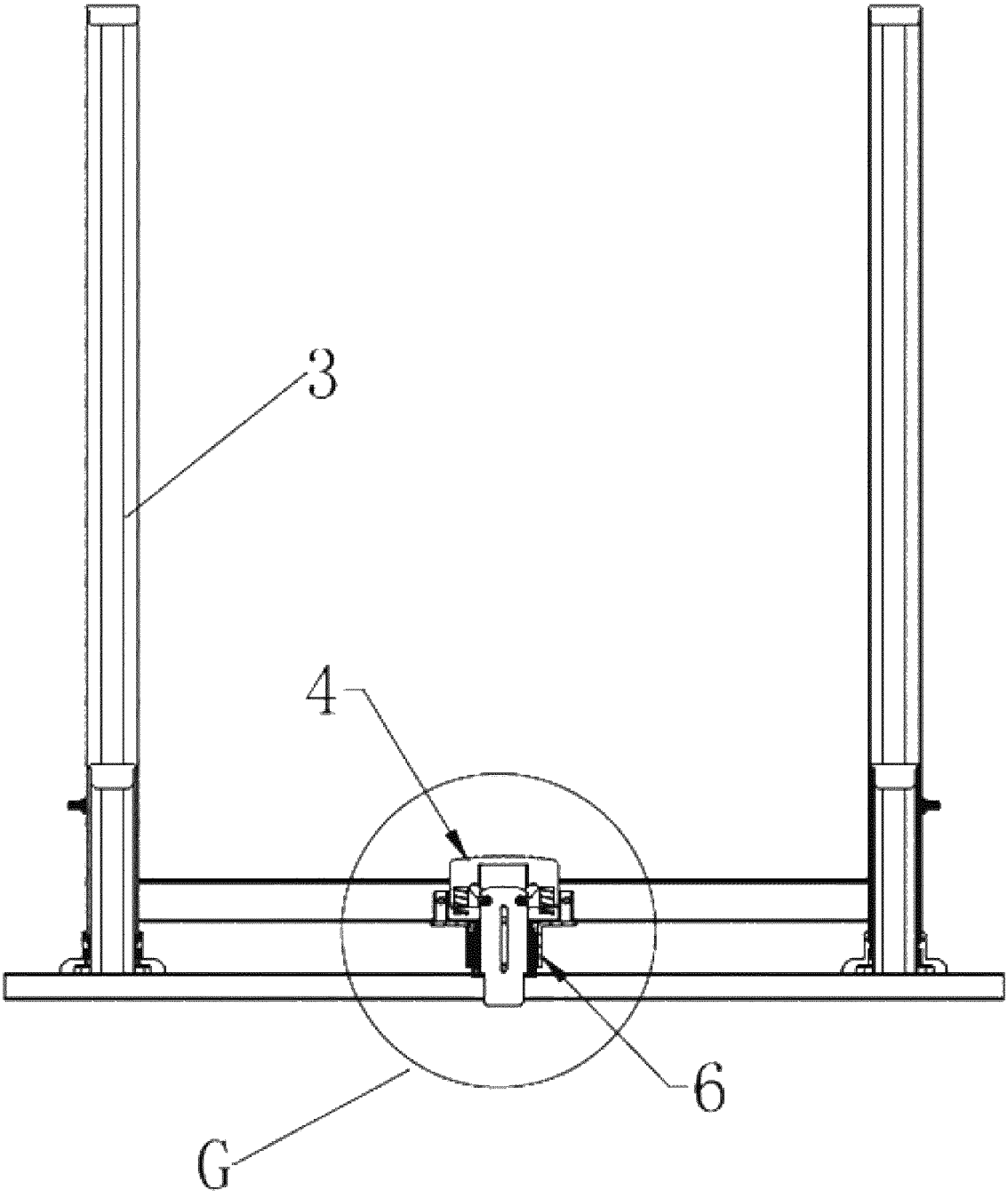
FIG. 20 is a sectional view illustrating a supporting assembly of the exemplary table of FIG. 19 in accordance with some exemplary embodiments of the present disclosure.

To fold the supporting assembly, the first and second components of the locking mechanism needs to be disengaged. To do so, a user can push the button toward the first bar (e.g., first lateral mounting bar 13 or second lateral mounting bar 14). As the button moves toward the first bar, each first pin moves along the second direction (e.g., the y-direction in FIGS. 3 and 12) and away from the corresponding coupling member. For instance, in the embodiment illustrated in FIGS. 3 and 6, the left-hand side first pin moves to the right, away from coupling member 421, and the right-hand side first pin moves to the left, away from coupling member 422. In the embodiment illustrated in FIGS. 12 and 15, the left-hand side first pin moves to the left, away from coupling member 421, and the right-hand side first pin moves to the right, away from coupling member 422. This disengages each coupling member from the corresponding first pin. As a result, the inner and outer bars of each leg of the supporting assembly can be moved away from each other, and the supporting assembly can be folded as illustrated in FIGS. 7 and 16.

Figure 11:
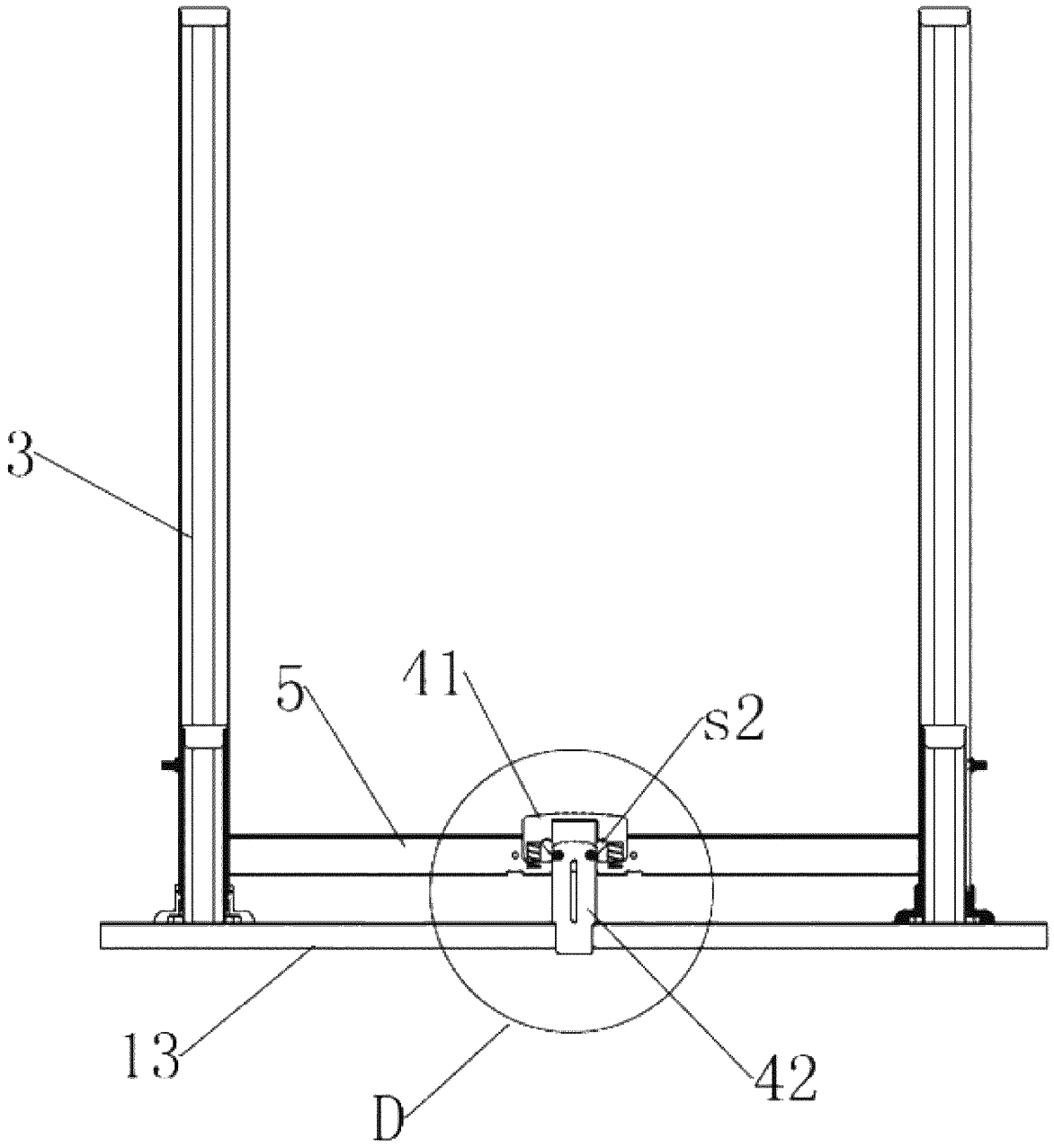
FIG. 11 is a sectional view illustrating a supporting assembly of the exemplary table of FIG. 10 in accordance with some exemplary embodiments of the present disclosure.
Figure 12:
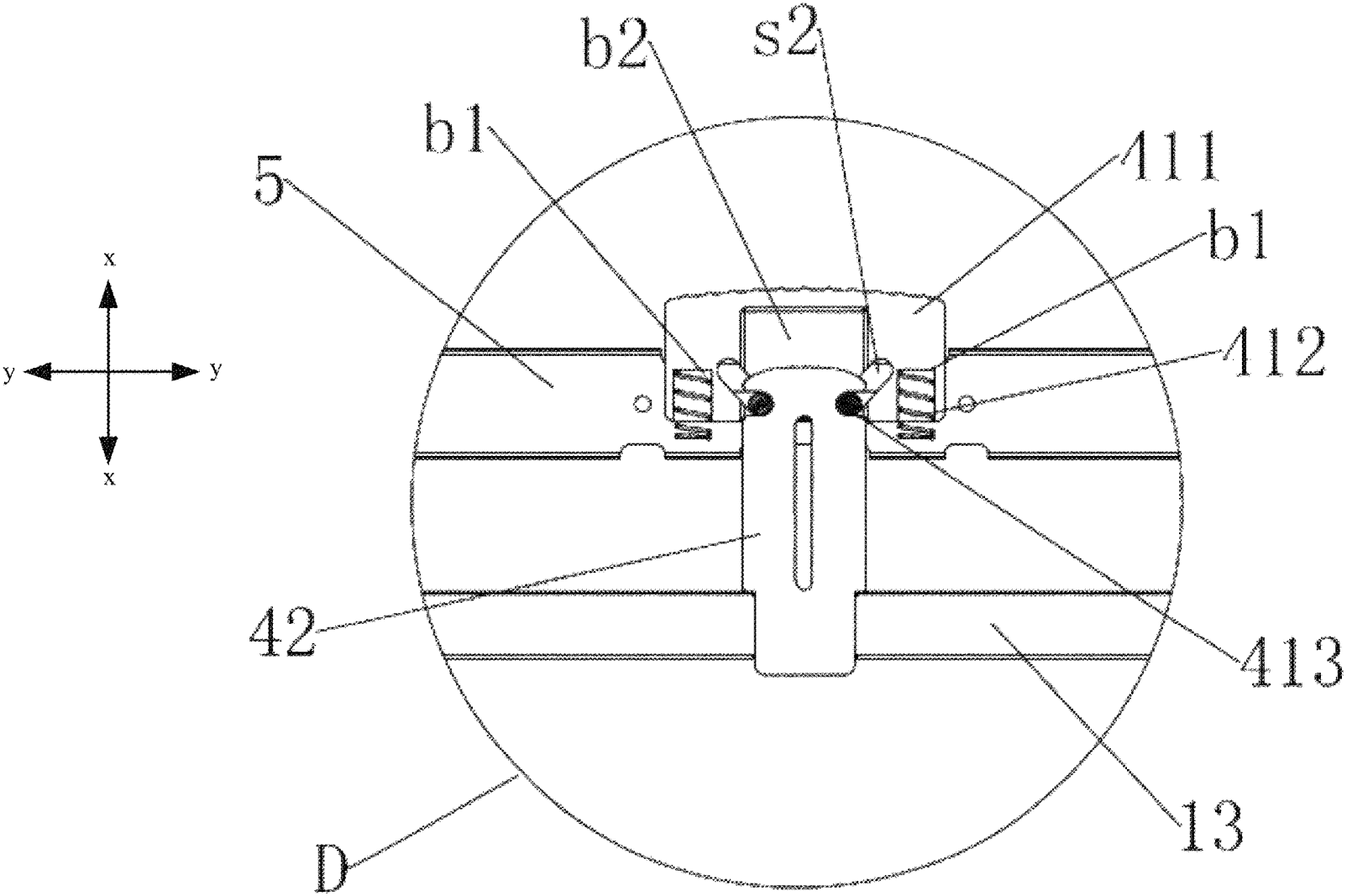
FIG. 12 is an enlarged view taken along circle D of FIG. 11.
Figure 13:
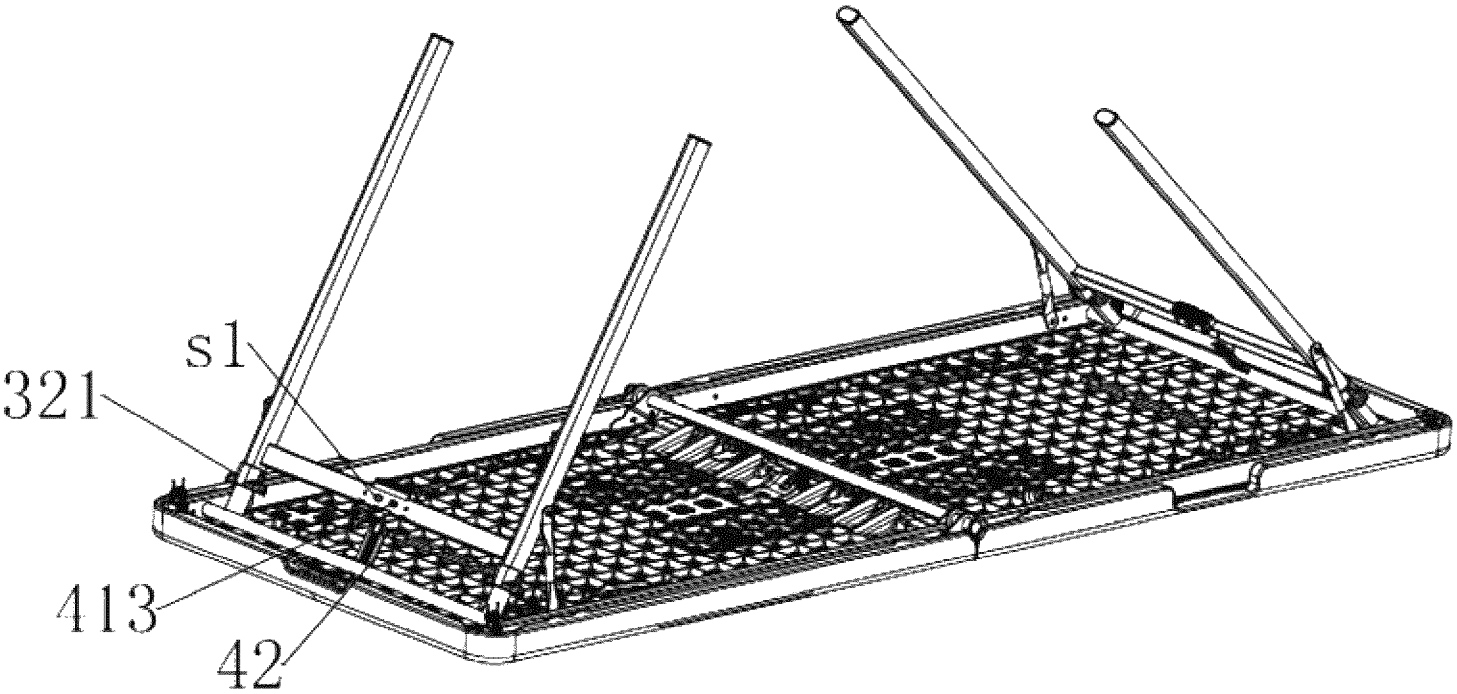
FIG. 13 is a bottom perspective view illustrating the exemplary table of FIG. 10, wherein leg assemblies are in an intermediate state, in accordance with some exemplary embodiments of the present disclosure.
Figure 14:
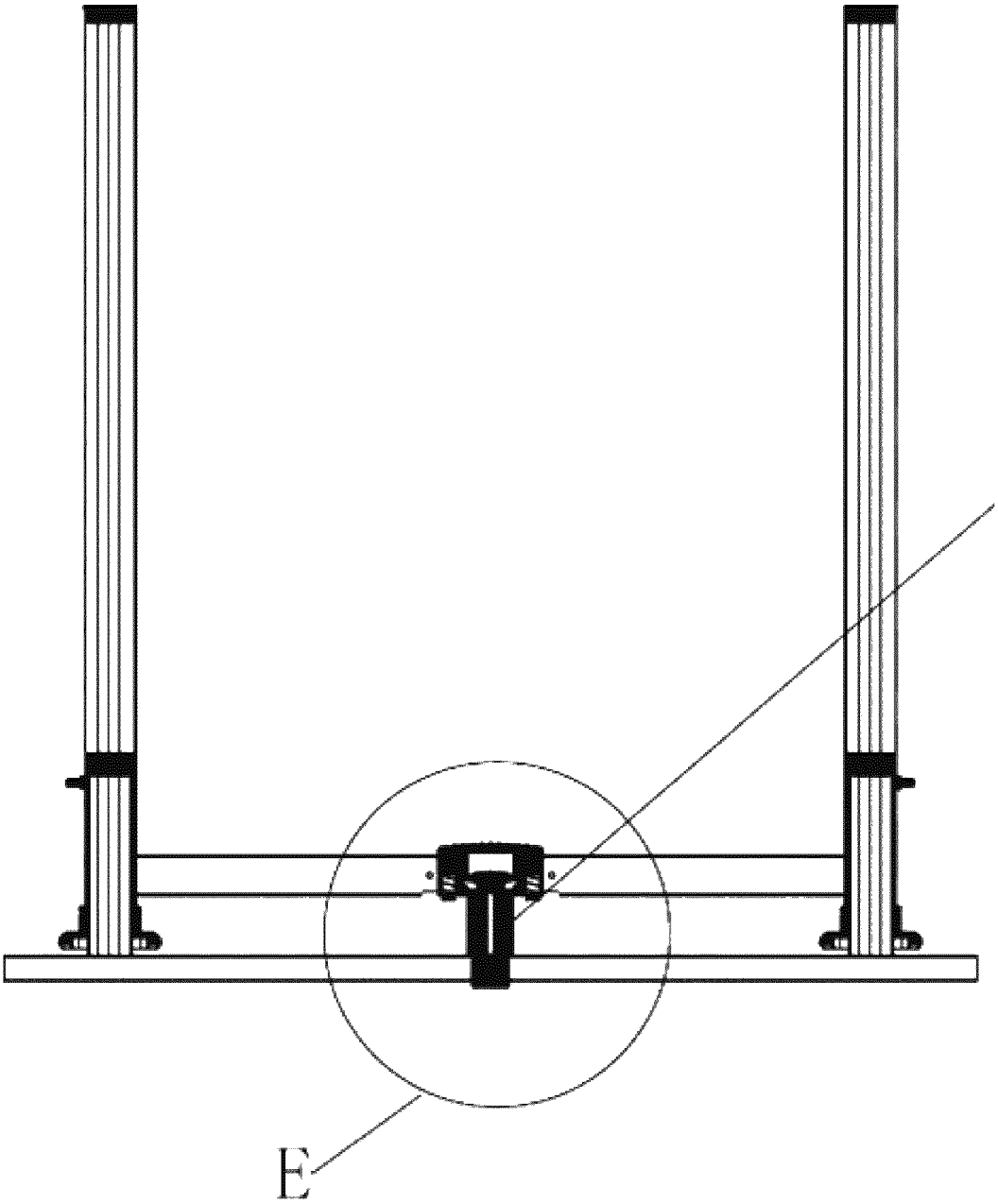
FIG. 14 is a sectional view illustrating a supporting assembly of the exemplary table of FIG. 13 in accordance with some exemplary embodiments of the present disclosure.

To unfold the supporting assembly, a user can simply rotate the supporting assembly away from the table panel. Rotating the supporting assembly away from the table panel causes the inner and outer bars of each leg of the supporting assembly to move toward each other. This brings the first bar and the second bar closer and closer until the proximal end (e.g., supporting piece 321) of the outer bar of the leg abuts the first bar as illustrated in FIGS. 2 and 11. During this process, the one or more coupling members of the first component of the locking mechanism are inserted into the one or more openings of the second bar (e.g., lateral bar 5), and then into the one or more second cavities of the button as illustrated in FIGS. 6 and 15. While on its way to the one or more second cavities, the one or more coupling members push the one or more first pins along the first and/or second slots. Once the one or more coupling members are inserted into the one or more second cavities of the button, the one or more elastic members push the button to move in the first direction away from the first bar. The movement of the button in turn causes the one or more first pins to move along the first and/or second slots and toward the one or more coupling members of the first component of the locking mechanism, thereby engaging the one or more first pins with the one or more coupling members of the first component of the locking mechanism. As such, the first component of the locking mechanism is locked again with the second component of the locking mechanism. In some exemplary embodiments, each coupling member of the first component of the locking mechanism includes an inclined (e.g., curved, arched) portion to facilitate the insertion of the coupling member and a recessed portion to grasp the corresponding first pin.

Referring to FIGS. 19-27 (in particular FIGS. 21, 24 and 27), in some exemplary embodiments, the supporting assembly includes a protecting component, such as protecting component 6. The protecting component is connected to the second bar (e.g., lateral bar 5) of the supporting assembly and the first component of the locking mechanism, and configured to enhance safety during operation of the supporting assembly and/or use of the table (e.g., to prevent accidental pinching of user's fingers by the locking mechanism).

For instance, in some exemplary embodiments, the first component of the locking mechanism includes a third slot, such as third slot 42*a*. The third slot is generally elongated in the first direction (e.g., the x-direction in FIG. 27). The protecting component includes a plurality of segments connected to each other and movable relative to each other along the first direction. The protecting component can include any suitable number of segments, such as two, three, four, five or more than five segments. As a non-limiting example, three segments, e.g., segment 61, segment 62 and segment 63, are illustrated. In some exemplary embodiments, the protecting component is made of a plastic.

In some exemplary embodiments, a first segment (e.g., segment 61) is sleeved on the first component of the locking mechanism. A second segment (e.g., segment 62) is connected to the second bar. In embodiments with more than two segments, the first and second segments are connected to each other through one or more segments (e.g., segment 63) disposed between the first and second segments. In some exemplary embodiments, a segment is sleeved on another segment. For instance, in the illustrated embodiment, segment 63 is sleeved on segment 61, and segment 62 is sleeved on segment 63.

Figure 21:
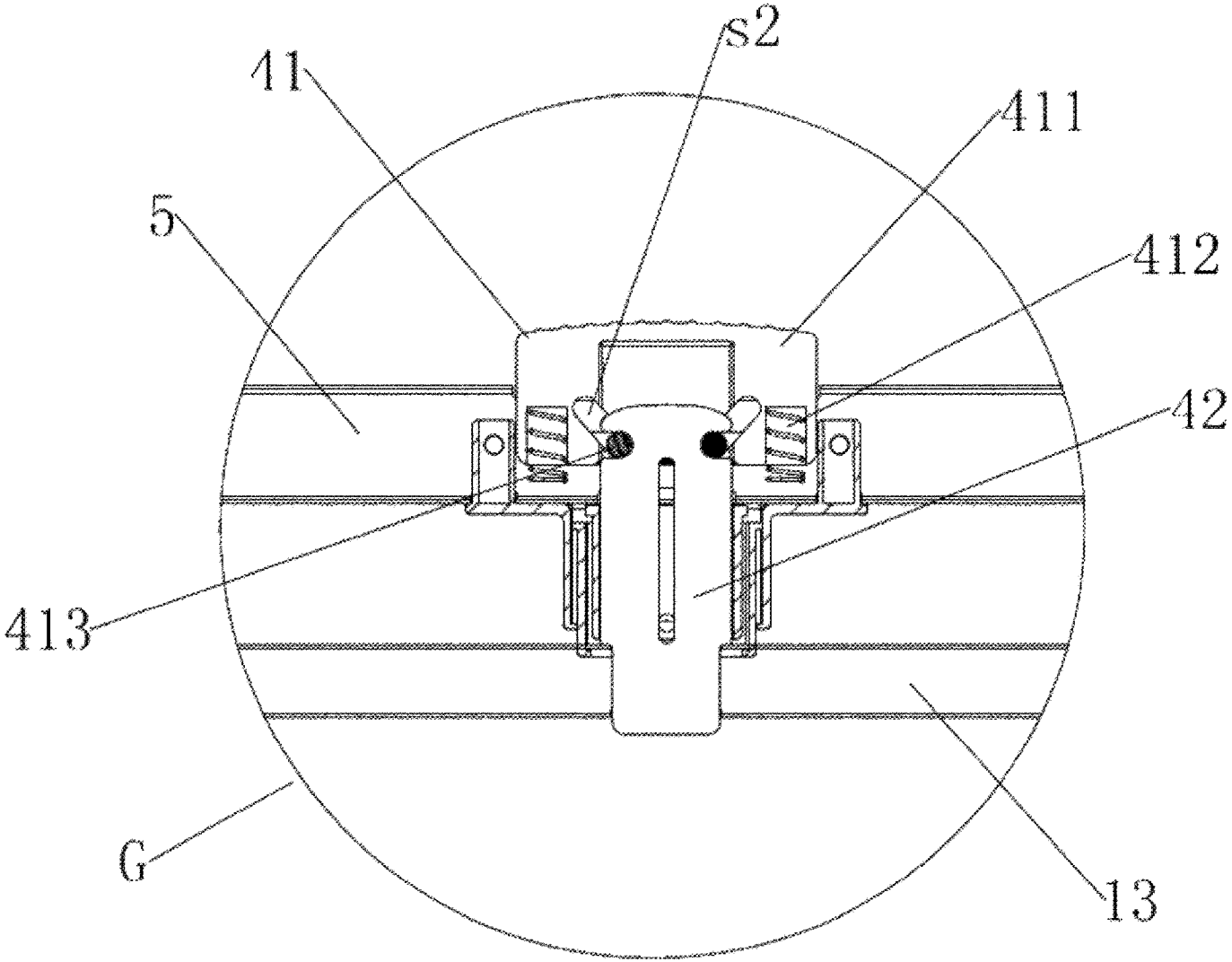
FIG. 21 is an enlarged view taken along circle G of FIG. 20.
Figure 22:
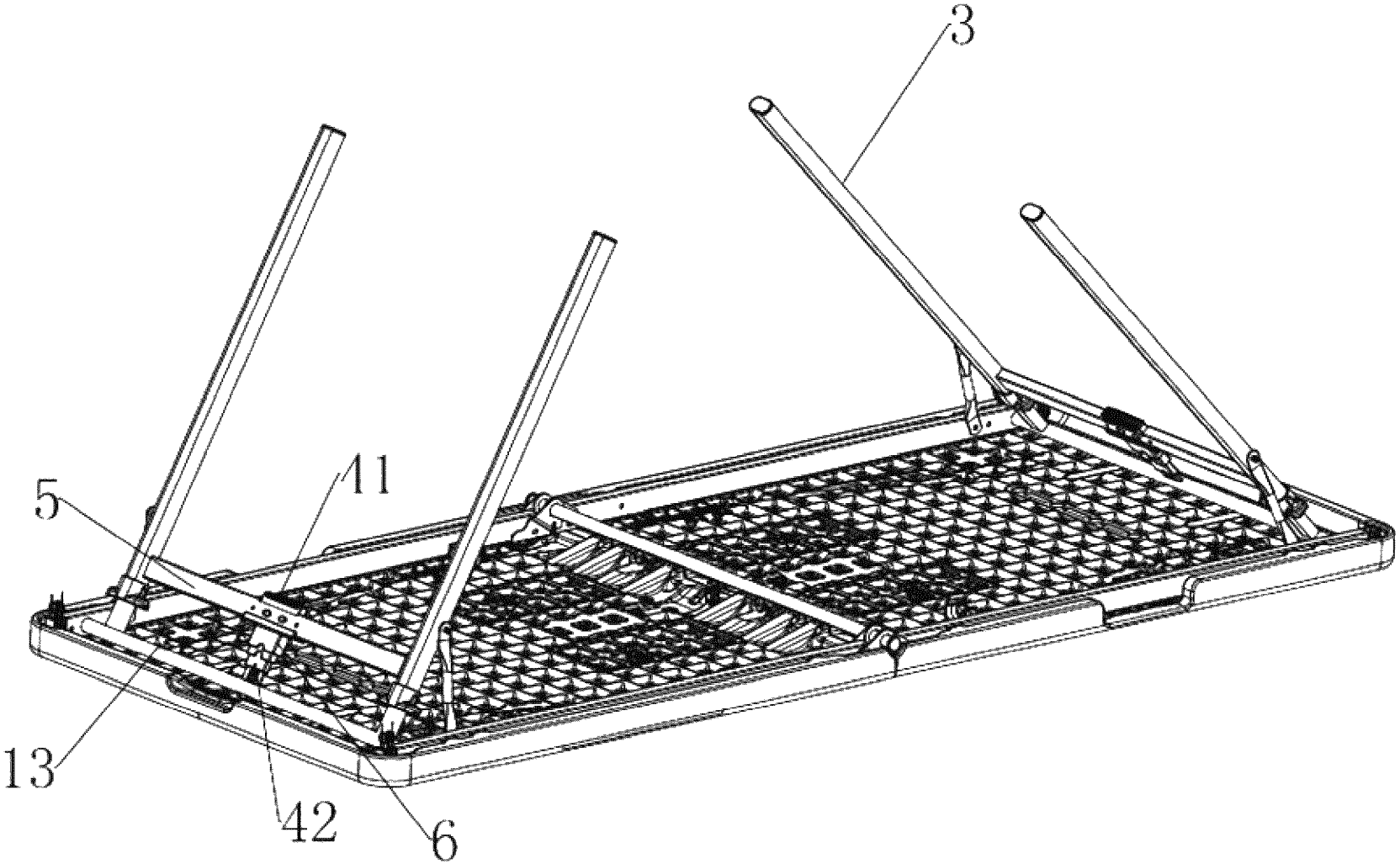
FIG. 22 is a bottom perspective view illustrating the exemplary table of FIG. 19, wherein leg assemblies are in an intermediate state, in accordance with some exemplary embodiments of the present disclosure.
Figure 23:
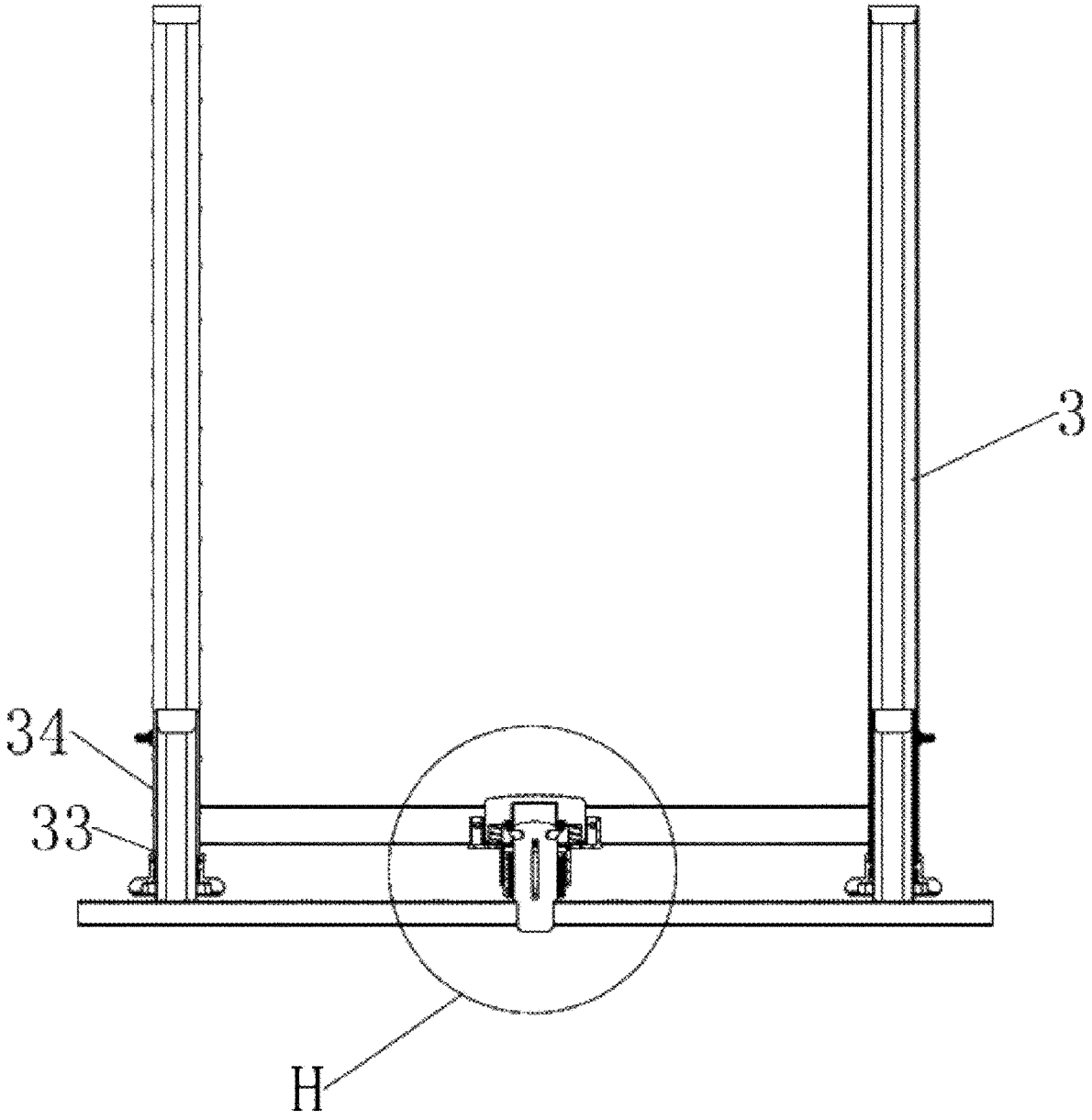
FIG. 23 is a sectional view illustrating a supporting assembly of the exemplary table of FIG. 22 in accordance with some exemplary embodiments of the present disclosure.
Figure 24:
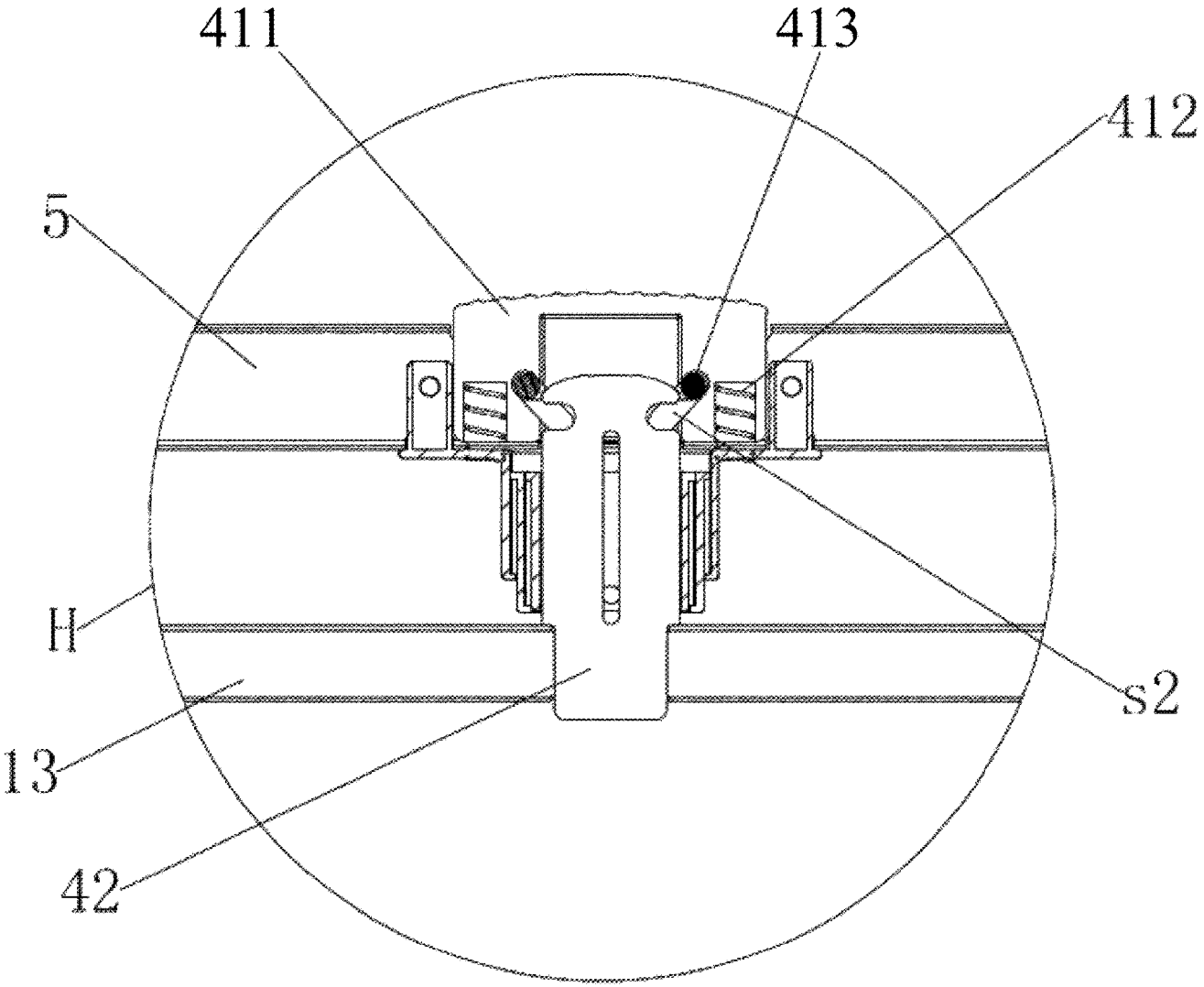
FIG. 24 is an enlarged view taken along circle H of FIG. 23.
Figure 25:
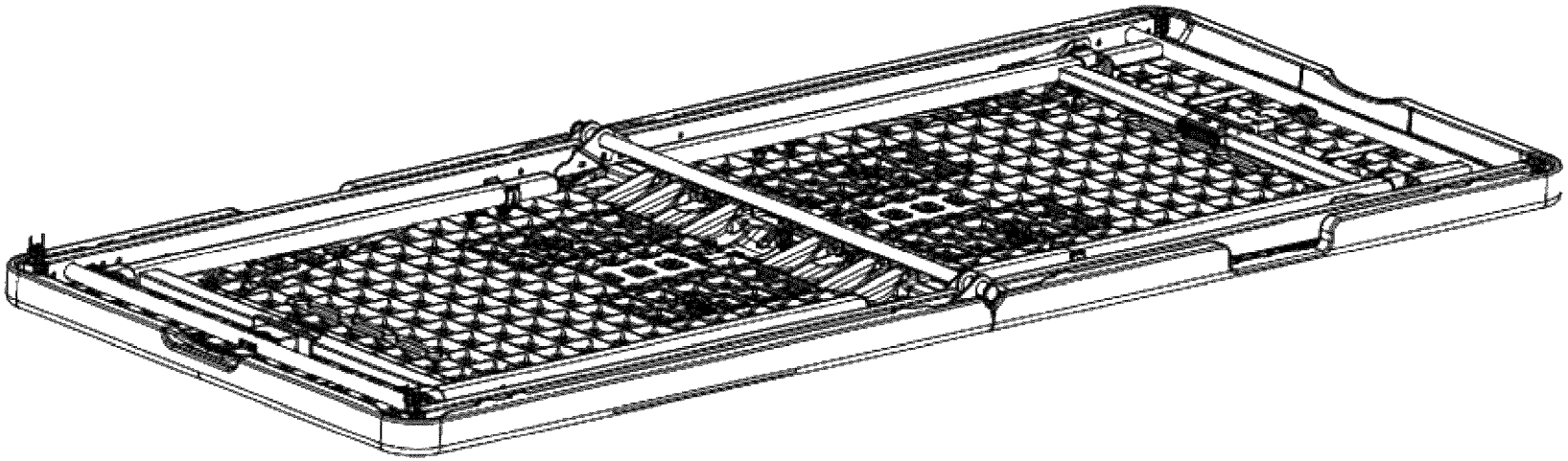
FIG. 25 is a bottom perspective view illustrating the exemplary table of FIG. 19, wherein leg assemblies are in a folded state, in accordance with some exemplary embodiments of the present disclosure.
Figure 26:
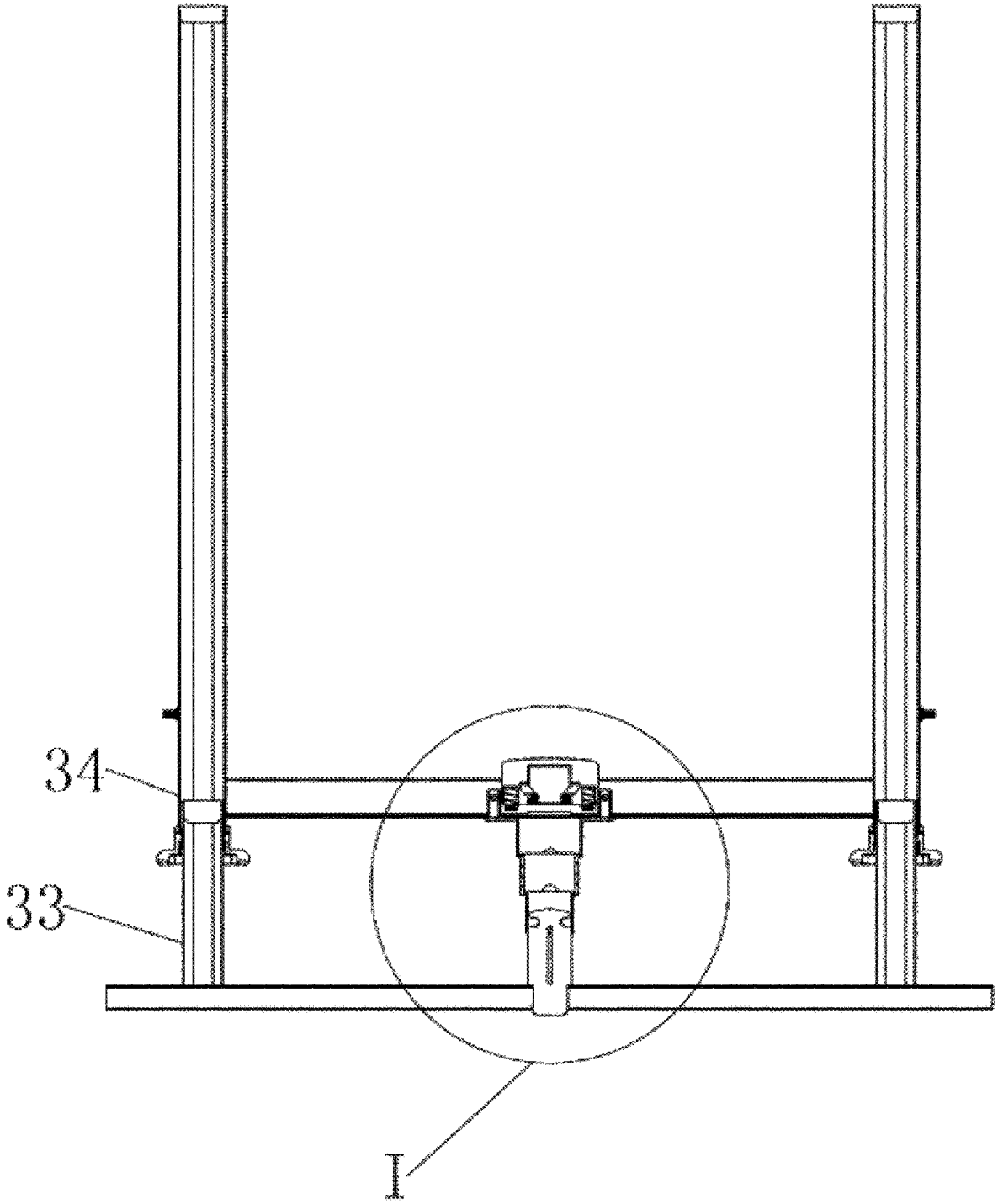
FIG. 26 is a sectional view illustrating a supporting assembly of the exemplary table of FIG. 25 in accordance with some exemplary embodiments of the present disclosure.
Figure 27:
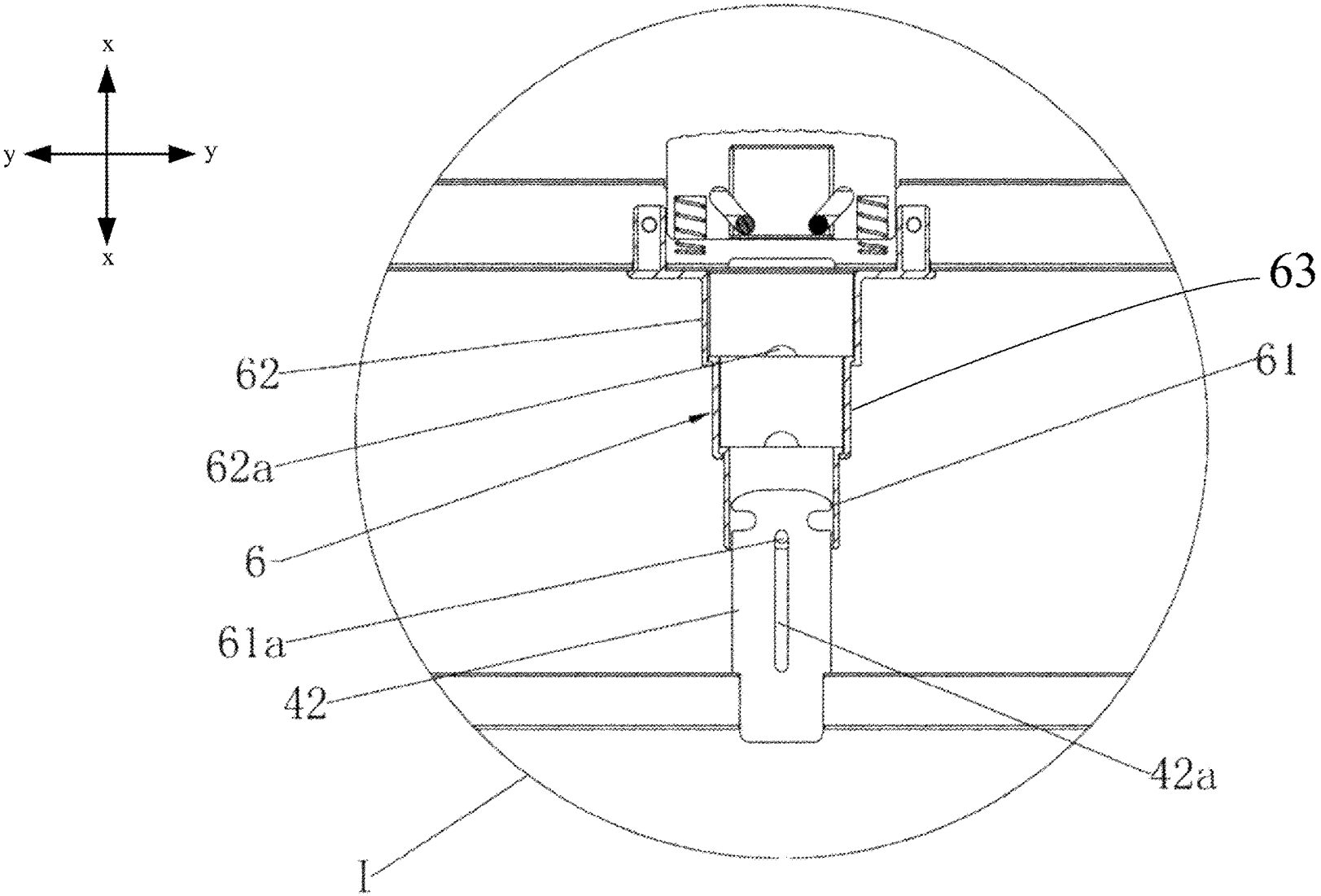
FIG. 27 is an enlarged view taken along circle I of FIG. 26.

In some exemplary embodiments, a second pin, such as second pin 61*a*, is disposed at (e.g., formed or coupled with) the first segment. The second pin is inserted into the third slot of the first component of the locking mechanism and movable along the third slot. As such, the first segment is allowed to move relative to the first component of the locking mechanism along the first direction within a range, e.g., a range defined by the dimension of the third slot along the first direction. In some exemplary embodiments, the second segment includes a fourth slot, such as fourth slot 62*a*, at a side facing the first component of the locking mechanism to accommodate the second pin. This allows the plurality of segments to collapse more closely as illustrated in FIGS. 21 and 24, thereby reducing the size of the contracted protecting component when the supporting assembly is in an unfolded state. When folding the supporting assembly, the first and second components of the locking mechanism are disengaged from each other. The protecting component expands along the first direction, and/or the first segment of the protecting component moves away from the first bar (e.g., first lateral mounting bar 13 or second lateral mounting bar 14) until the second pin abuts an end of the fourth slot or until the supporting assembly is folded.

While tables are illustrated, it should be noted that this is by way of example and it is not limiting. The locking mechanisms, protecting components, and supporting assemblies can be used in other foldable structures, such as foldable frames, foldable beds, foldable benches, etc. For instance, a foldable structure can include one or more supporting assemblies of the present disclosure coupled to one or more mounting members (e.g., first and second longitudinal mounting members). A foldable structure can also include a plurality of links, such as link 31 and/or link 32. A foldable structure can further include one or more panels coupled to the one or more mounting members and supported by the one or more supporting assemblies. With the locking mechanisms and/or protecting components, the supporting assemblies and foldable structures (e.g., tables) of the present disclosure are simple, safe and convenient to use.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "top" or "bottom", "lower" or "upper", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first bar could be termed a second bar, and, similarly, a second bar could be termed a first bar, without changing the meaning of the description, so long as all occurrences of the "first bar" are renamed consistently and all occurrences of the "second bar" are renamed consistently.

What is claimed is:

1. A supporting assembly comprising:

a first bar;

a first leg and a second leg, each comprising an inner bar and an outer bar, wherein a distal end of the inner bar is connected to the first bar, a distal end of the outer bar is configured to abut a surface, and the inner and outer bars are coupled with each other and movable relative to each other in a first direction;

a second bar connected to the outer bar of the first leg and the outer bar of the second leg; and a locking mechanism comprising a first component disposed at the first bar and a second component disposed at the second bar, wherein the first and second components are operable to selectively engage with each other to prevent relative movement of the inner and outer bars of each of the first and second legs or disengage from each other to allow relative movement of the inner and outer bars of each of the first and second legs.

2. The supporting assembly of claim 1, wherein the second bar is substantially parallel to the first bar.

3. The supporting assembly of claim 1, wherein when the first and second components of the locking mechanism are engaged with each other, a proximal end of the outer bar of the first or second leg abuts the first bar.

4. The supporting assembly of claim 3, wherein the proximal end of the outer bar comprises a supporting piece having a recess to fit on the first bar when the first and second components of the locking mechanism are engaged with each other.

5. The supporting assembly of claim 1, wherein the first component of the locking mechanism comprises a tongue and the second component of the locking mechanism comprises a buckle.

6. The supporting assembly of claim 1, wherein:

the second bar comprises one or more openings on a first side and one or more first slots on a second side of the second bar, wherein the first side of the second bar faces the first bar, and each of the one or more first slots is elongated in a second direction substantially perpendicular to the first direction;

the first component of the locking mechanism comprises one or more coupling members insertable into the one or more openings of the second bar; and the second component of the locking mechanism comprises a button and one or more first pins, wherein the button comprises one or more second slots each elongated in a direction oblique to both of the first and second directions and corresponding to a first slot in the one or more first slots of the second bar, wherein:

each respective first pin in the one or more first pins is inserted into a corresponding first slot in the one or more first slots of the second bar and a corresponding second slot in the one or more second slots of the button, and movable along the corresponding first slot and the corresponding second slot, thereby allowing the button to move relative to the second bar in the first direction, and movement of the button relative to the second bar in the first direction causes the one or more first pins to move along the one or more first slots of the second bar in the second direction, thereby allowing the one or more coupling members of the first component to engage with or disengage from the one or more first pins of the second component of the locking mechanism.

7. The supporting assembly of claim 6, wherein:

the one or more openings of the second bar comprise a first opening and a second opening; and the one or more coupling members of the first component of the locking mechanism comprise a first coupling member insertable into the first opening of the second bar and a second coupling member insertable into the second opening of the second bar.

8. The supporting assembly of claim 6, wherein:

the one or more openings of the second bar comprise a first opening; and the one or more coupling members of the first component of the locking mechanism comprise a first coupling member and a second coupling member, both insertable into the first opening of the second bar.

9. The supporting assembly of claim 6, wherein a coupling member in the one or more coupling members of the first component of the locking mechanism comprises a hook.

10. The supporting assembly of claim 6, wherein:

the second bar comprises two first slots disposed side by side along the second direction;

the button of the second component of the locking mechanism comprises two second slots; and the second component of the locking mechanism comprises two first pins each inserted into one of the two first slots and one of the two second slots.

11. The supporting assembly of claim 6, wherein each of the one or more second slots of the button is oblique to the first direction at an angle of about 45°, or about 135°.

12. The supporting assembly of claim 6, wherein:

the second bar comprises two openings and two first slots;

the first component of the locking mechanism comprises two coupling members each insertable into one of the two openings of the second bar;

the button of the second component of the locking mechanism comprises two second slots;

the second component of the locking mechanism comprises two first pins each inserted into one of the two first slots and one of the two second slots;

a first cavity is formed at the button between the two second slots; and an elastic member is accommodated at least in part in the first cavity, the elastic member having a first end abutting the first side of the second bar and a second end abutting the button, thereby holding the button at a position, in the absence of any external force, that is away from the first bar.

13. The supporting assembly of claim 6, wherein:

the second bar comprises a first opening and two first slots;

the first component of the locking mechanism comprises two coupling members, both insertable into the first opening of the second bar;

the button of the second component of the locking mechanism comprises two second slots;

the second component of the locking mechanism comprises two first pins each inserted into one of the two first slots and one of the two second slots;

two first cavities are formed at the button, where the two second slots are disposed between the two first cavities; and a first elastic member is accommodated at least in part in one of the two first cavities and a second elastic member is accommodated at least in part in the other of the two first cavities, each of the first and second elastic members having a first end abutting the first side of the second bar and a second end abutting the button, thereby holding the button at a position, in the absence of any external force, that is away from the first bar.

14. The supporting assembly of claim 6, wherein the button comprises one or more second cavities for accommodating the one or more coupling members of the first component of the locking mechanism.

15. The supporting assembly of claim 6, further comprising:

a protecting component connected to the second bar and the first component of the locking mechanism, wherein the protecting component encompasses the one or more openings of the second bar and the one or more coupling members of the first component of the locking mechanism, thereby enhancing safety during operation of the locking mechanism.

16. The supporting assembly of claim 15, wherein:

the first component of the locking mechanism comprises a third slot elongated in the first direction;

the protecting component comprises a plurality of segments connected to each other and movable relative to each other along the first direction;

a first segment in the plurality of segments is sleeved on the first component of the locking mechanism;

a second pin is disposed at the first segment and inserted into the third slot of the first component of the locking mechanism, wherein the second pin is movable along the third slot, thereby allowing the first segment to move relative to the first component of the locking mechanism along the first direction within a range; and a second segment in the plurality of segments is connected to the second bar.

17. The supporting assembly of claim 16, wherein the second segment comprises a fourth slot at a side facing the first component of the locking mechanism to accommodate the second pin.

18. The supporting assembly of claim 16, wherein the first and second segments are connected to each other through one or more segments between the first and second segments.

19. A foldable structure comprising:

a first longitudinal mounting member and a second longitudinal mounting member; and a pair of supporting assemblies of claim 1, wherein the first bar of one supporting assembly is rotatably connected to the first and second longitudinal mounting members at a first side of the foldable structure and the first bar of the other supporting assembly is rotatably connected to the first and second longitudinal mounting members at a second side of the foldable structure.

20. The foldable structure of claim 19, further comprising:

a plurality of links, each having a first end pivotally connected to the outer bar of the first or second leg of a supporting assembly in the pair of supporting assemblies and a second end pivotally connected to the first or second longitudinal mounting member.

* * * * *